US011802395B2

(12) United States Patent
Lerch

(10) Patent No.: US 11,802,395 B2
(45) Date of Patent: Oct. 31, 2023

(54) MODIFIED FAUCET HOSE SYSTEM AND VALVE ASSEMBLY

(71) Applicant: Michael Lerch, Denver, CO (US)

(72) Inventor: Michael Lerch, Denver, CO (US)

( * ) Notice: Subject to any disclaimer, the term of this patent is extended or adjusted under 35 U.S.C. 154(b) by 0 days.

(21) Appl. No.: 17/548,974

(22) Filed: Dec. 13, 2021

(65) Prior Publication Data

US 2022/0186474 A1 Jun. 16, 2022

Related U.S. Application Data

(60) Provisional application No. 63/124,264, filed on Dec. 11, 2020.

(51) Int. Cl.
*E03C 1/04* (2006.01)
*E03C 1/02* (2006.01)

(52) U.S. Cl.
CPC ..... *E03C 1/041* (2013.01); *E03C 1/0403* (2013.01); *E03C 2001/026* (2013.01)

(58) Field of Classification Search
CPC ... E03C 1/041; E03C 1/0403; E03C 2001/026
See application file for complete search history.

(56) References Cited

U.S. PATENT DOCUMENTS 4,423,752 A 1/1984 Psarouthakis
4,609,007 A 9/1986 Uhl
4,917,294 A 4/1990 Bergmann et al.
5,819,785 A 10/1998 Bardini
5,931,181 A 8/1999 Cook et al.
6,119,947 A 9/2000 Couture et al.
6,929,188 B2 8/2005 Taylor et al.
7,000,850 B2 2/2006 Lin
(Continued)

FOREIGN PATENT DOCUMENTS

CA 1 257 524 A 7/1989
CN 200989475 Y 12/2007
(Continued)

OTHER PUBLICATIONS

International Search Report and Written Opinion received for International PCT Application Serial No. PCT/US2021/063090 dated Feb. 25, 2022, 13 pages.
(Continued)

*Primary Examiner* — Patrick C Williams
(74) *Attorney, Agent, or Firm* — Neugeboren O'Dowd PC

(57) ABSTRACT

A system, a method, and an apparatus for a temperature-adjusting adapter is described. The adapter includes first and second connectors coupled to first and second supply lines, wherein each of the first and second connector comprise an input, an output, and an adjustment port; a tube and an adjustment mechanism positioned between the adjustment ports of the first and second connectors, wherein the adjustment mechanism is movable between an open position and a closed position for selecting a temperature of a third fluid exiting the output port of the first or the second connector, wherein the third fluid is one of the first fluid, the second fluid, or a mixture of the first fluid and the second fluid, and wherein a mixing ratio of the mixture is based at least in part on the position of the adjustment mechanism.

19 Claims, 20 Drawing Sheets

(56) References Cited

U.S. PATENT DOCUMENTS

| | | | | |
|---|---|---|---|---|
| 7,028,702 | B2 | 4/2006 | Park et al. | |
| 7,886,987 | B2 | 2/2011 | Guterman | |
| 8,074,894 | B2 | 12/2011 | Beagen | |
| 9,170,584 | B2 | 10/2015 | Lum et al. | |
| 9,234,597 | B2 | 1/2016 | Kemp et al. | |
| 9,268,342 | B2 | 2/2016 | Beyerle et al. | |
| 9,863,647 | B1 | 6/2018 | Mcnamara et al. | |
| 10,138,620 | B2 | 11/2018 | Block et al. | |
| 2003/0183275 | A1 | 10/2003 | Yang | |
| 2009/0078218 | A1* | 3/2009 | Gordon | F24H 9/133 122/13.3 |
| 2010/0123015 | A1 | 5/2010 | Beagen | |
| 2014/0060660 | A1 | 3/2014 | Ebkuchner et al. | |
| 2020/0158257 | A1* | 5/2020 | Dolgos | F16K 43/003 |

FOREIGN PATENT DOCUMENTS

| | | | |
|---|---|---|---|
| DE | 699 20 431 | T2 | 10/2005 |
| DE | 20 2006 006 855 | U1 | 7/2006 |
| EP | 1072830 | A1 | 1/2001 |
| EP | 1 744 107 | A1 | 1/2007 |
| GB | 2 376 290 | A | 12/2002 |
| JP | 2016-089429 | A | 5/2016 |
| WO | 2018/124454 | A1 | 7/2018 |

OTHER PUBLICATIONS

"Series LFUSG-B Under Sink Guardian", Watts, pp. 2, 2020.
"SinkMixer™ Scald Protection Thermostatic Mixing Valve, 5212", Caleffi Hydronic Solutions, pp. 4, 2020.
"AM-1-Series Thermostatic Mixing Valve, Thermostatic Mixing Valves", Honeywell, pp. 8, 2009.
Freidt, Kevin, "The Safest way to Prevent Hot Water Scalding", Plumbing & Mechanical, pp. 36-45, May 2020.
Doherty, Fiona, "International Preliminary Report on Patentability Regarding PCT/US2021/063090", dated Jun. 22, 2023, p. 7, Published in: CH.

* cited by examiner

MODIFIED FAUCET HOSE SYSTEM AND VALVE ASSEMBLY

CROSS-REFERENCE TO RELATED APPLICATIONS

The present application for Patent claims priority to U.S. Provisional Application No. 63/124,264 and entitled "Modified Faucet Hose System and Valve Assembly," filed Dec. 11, 2020, which is incorporated herein by reference in its entirety.

FIELD OF THE DISCLOSURE

The present disclosure relates generally to faucet hose systems. In particular, but not by way of limitation, the present disclosure relates to systems, methods and apparatuses for a modified faucet hose system that blends hot and cold water to minimize risk of scalding.

DESCRIPTION OF RELATED ART

Current faucet hose systems, especially those designed for use with both hot and cold-water supply lines, suffer some deficiencies. In some cases, single faucet sinks connected to both hot and cold-water supply lines are prone to scalding or burning users. Thus, there is a need for a refined faucet hose system that alleviates some of the issues with existing designs.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

Existing techniques for controlling and mixing hot and cold-water flow, for instance, in single faucet sinks, are lacking in some regards. In some cases, stand-alone mixing valves or other mixing valves are installed in-line with water pipes to vary the amount of cold and hot water mixing. Often, such mechanical mixing valves need to be professionally installed by a plumber since a layperson may not have the required knowledge and/or tools for performing the installation, which often involves the cutting, measuring, and soldering of the water pipes.

Generally, aspects of the present disclosure relate to a modified faucet hose system that is adapted to blend cold water with a hot water stream prior to entering a hot water faucet valve of a sink, which may serve to alleviate the risk of scalding. Some embodiments of the disclosure may be characterized as a temperature-adjusting adapter system that is configured to fit in-line with existing faucet supply hoses. In some cases, one or more hoses (e.g., steel braided hoses) may be built into the adapter system. Furthermore, the adapter system may comprise one or more valves, such as mechanical mixing valves, one-way check valves, disc or disc-type valves, ball valves, such as standard ball valves, to name a few non-limiting examples. In some examples, a valve (e.g., a ball valve) may be designed for up to 90 degree of rotation, which may allow for up to (or about) a 50-50% mix (i.e., 1:1 ratio) of hot and cold-water flow from the sink faucet. In this cases, the mixing ratio of a first fluid (e.g., cold water) to the second fluid (e.g., hot water) exiting an output port of one of the connectors (e.g., hot side tee connector 103 in FIG. 1, connector 302-*a* in FIG. 3, connector 402-*a* in FIG. 4) may be anywhere between a minimum mixing ratio (e.g., about 0% or about 0:1 cold to hot water) and a maximum mixing ratio (e.g., at least about 50% or about 1:1 cold:hot water). It should be noted that, the mixing ratios described herein are not intended to be limiting, and other percentages or ratios of hot to cold water are contemplated in different embodiments. In some aspects, a standard ball valve with 90 degree of rotation may meter the amount of cold water flowing into the hot side and may sufficiently lower the hot water temperature to reduce the risk of scalding (i.e., even with about 50-50% mix). In some other cases, the ball valve may additionally comprise a slot or "canyon" cut through it, which may allow for different mixing ratios (e.g., from 100% cold to 100% hot, and anywhere in between). In such cases, the minimum mixing ratio may be about 0% or 0:1 cold to hot water, while the maximum mixing ratio may be about 100% or 1:0 cold to hot water. In some instances, such a ball valve may be referred to as a rotating ball valve, to differentiate it from a standard ball valve that allows for up to a 50-50% mix. In some other cases, a disc or disc-type valve may be used in lieu of a ball valve to adjust the mixing ratio. In some examples, disc or disc-type valves may allow for a mixing ratio from 100% cold to 100% hot, and anywhere in between. It should be noted that, as used herein with reference to mixing ratios, the term "about" or "approximately" may refer to a range of mixing ratios within X % of the referenced mixing ratio, where 'X' may be 2%, 5%, 10%, etc. In some cases, the range may be centered around a given mixing ratio (e.g., ±2% when mixing ratio is about 50%, for instance, anywhere between 48% and 52%; up to 2% when mixing ratio is 0%; up to 5% when mixing ratio is 0%; ±5% when mixing ratio is about 50% for instance, anywhere between 45% and 55%, to name a few non-limiting examples).

In some cases, the temperature-adjusting adapter system (simply referred to as adapter system) may be configured to fit in-line between the water supply pipes (or lines) and existing faucet supply hoses. In such cases, the adapter system may be designed to accommodate faucets with built-in, non-detachable, steel braided supply hoses, as well as those without. In some other cases, the adapter system may be designed to replace existing faucet supply hoses, such that cold water blending occurs near a top of the hot water supply hoses. In such cases, the cold-water blending may occur closer to the hot water valve inlet of the faucet assembly, which may serve to optimize the cooling effect and minimize risk of scalding. In some cases, the adapter system may comprise one or more tee connectors (e.g., hot, and cold side tee connectors) that are custom manufactured to incorporate both one-way valves and ball or other types of valves, such as disc or disc-type valves. That is, the adapter system may not comprise separate individual components that need to be coupled and screwed together by the user. In some cases, the adapter system may also comprise custom length hoses (e.g., 10 inches, 15 inches, 20 inches, 30 inches, etc.) that are permanently attached to said tee connectors, allowing for use with different sink and faucet assemblies, in addition to providing plenty of clearance around existing plumbing drainpipes or other items under the sink area. Further, the individual components of the tee connectors may be non-detachable, which may ease installation by a user.

In some aspects, the temperature-adjusting adapter system may be a quick-connect, easy to install, in-line adapter. In this way, a layperson with minimal plumbing knowledge and/or specialized tools may be able to install and use the adapter system of the present disclosure. Furthermore, because no plumbing hardware modifications are required for installation and operation, the cost for an end user may be significantly lower than existing techniques using mechanical mixing valves, since no professional may be needed to perform the installation.

Some embodiments of the disclosure may be characterized as a temperature-adjusting adapter system, the temperature-adjusting adapter system comprising a first connector, where the first connector comprises at least two ports, including a first connector input port for receiving a first fluid at a first temperature and a first connector output port. The temperature-adjusting adapter system (or simply, adapter system) further comprises a second connector, where the second connector comprises at least three ports, including a second connector input port for receiving a second fluid at a second temperature, a second connector output port, and a second connector adjustment port. The adapter system further comprises a tube having a first end and a second end, wherein the first end is one of coupled and integrated at or near one of the at least two ports of the first connector and the second end is one of coupled and integrated at or near the second connector adjustment port. The temperature-adjusting adapter system also includes an adjustment mechanism, where the adjustment mechanism is one of coupled and integrated to the tube. In some embodiments, a change in an adjustment mechanism position varies an amount of second fluid transferred from the second connector to the first connector.

Other embodiments of the disclosure may be characterized as a method for adjusting fluid temperature, the method comprising: providing a temperature-adjusting adapter system, wherein the temperature-adjusting adapter system comprises a first connector, wherein the first connector comprises at least two ports, including a first connector input port for receiving a first fluid at a first temperature and a first connector output port; a second connector, wherein the second connector comprises at least three ports, including a second connector input port for receiving a second fluid at a second temperature, a second connector output port, and a second connector adjustment port; a tube having a first end and a second end, wherein the first end is one of coupled and integrated at or near one of the at least two ports of the first connector and the second end is one of coupled and integrated at or near the second connector adjustment port; and an adjustment mechanism one of coupled and integrated to the tube, the adjustment mechanism comprising a plurality of positions from an open position to a closed position. In some embodiments, the method further comprises moving the adjustment mechanism to one of the plurality of positions, wherein the one of the plurality of positions is associated with a third temperature of a third fluid exiting the first connector output port. In some embodiments, the third fluid is one of the first fluid, the second fluid, or a mixture of the first fluid and the second fluid, and a mixing ratio of the mixture is based at least in part on the one of the plurality of positions.

Still other embodiments of the disclosure may be characterized as a faucet system comprising: a faucet having at least two input ends and an output end, wherein the output end is in communication with the at least two input ends; a first supply line for providing a first fluid at a first temperature; a second supply line for providing a second fluid at a second temperature; a temperature-adjusting adapter system coupled to the first supply line, the second supply line, and the at least two input ends of the faucet. In some embodiments, the temperature-adjusting adapter system of the faucet system comprises a first connector, wherein the first connector comprises at least two ports, including a first connector input port and a first connector output port, wherein the first connector output port is connected to one of the at least two input ends of the faucet; a second connector, wherein the second connector comprises at least three ports, including a second connector input port, a second connector output port, and a second connector adjustment port, wherein the second connector output port is connected to another of the at least two input ends of the faucet; a tube having a first end and a second end, wherein the first end is one of coupled and integrated at or near one of the at least two ports of the first connector and the second end is one of coupled and integrated at or near the second connector adjustment port; and an adjustment mechanism one of coupled and integrated to the tube. In some embodiments of the faucet system, a change in a position of the adjustment mechanism varies an amount of second fluid transferred from the second connector and sets a temperature of a third fluid entering the another of the at least two input ends of the faucet, exiting the output end of the faucet, or a combination thereof. In some embodiments, the third fluid comprises one of the first fluid, the second fluid, or a mixture of the first fluid and the second fluid, and a mixing ratio of the mixture of the first fluid and second fluid is based at least in part on the position of the adjustment mechanism.

In some examples of the temperature-adjusting adapter system, the method, and the faucet system described above, the first connector further comprises a first connector adjustment port. In some embodiments, a first valve is positioned between the first connector adjustment port and the second connector adjustment port; and a second valve is one of coupled and integrated to the first connector at or near the first connector input port.

In some embodiments, the temperature-adjusting adapter system further comprises one or more crimps. In some examples of the temperature-adjusting adapter system, each of the one or more crimps comprise an inner diameter and are positioned between the first connector adjustment port and the second connector adjustment port. In some examples of the temperature-adjusting adapter system, the first valve comprises a check valve and the check valve fits within the inner diameter of the crimp(s).

In some examples of the temperature-adjusting adapter system the tube comprises an outer surface having an outer diameter; the one or more crimps couple to the outer surface; the adjustment mechanism is one of coupled and integrated at or near one of the first end and the second end of the tube; and varying an amount of second fluid transferred from the second connector to the first connector sets a third temperature of a third fluid exiting the first connector output port, wherein the third fluid comprises one of the first fluid, the second fluid, and a mixture of the first fluid and the second fluid.

In some examples of the temperature-adjusting adapter system, the first and the second valves comprise one-way check valves. In some examples of the temperature-adjusting adapter system, one of the first and the second valves prevents back flow of the first fluid from the first connector to the second connector input port and the second connector output port. In some embodiments, another of the first and the second valves prevents back flow of the second fluid and a third fluid to the first connector input port.

In some examples of the temperature-adjusting adapter system, a cracking pressure of the first valve comprises a pressure less than 0.5 psi, less than 1 psi, or less than 2 psi, and a cracking pressure of the second valve comprises a pressure less than 0.5 psi, less than 1 psi, or less than 2 psi. It should be noted that, the cracking pressures described herein are exemplary only and not intended to be limiting. Other cracking pressures (e.g., less than 3 psi, less than 5 psi, etc.) are contemplated in different embodiments.

In some examples of the temperature-adjusting adapter system, the first connector and the second connector are selected from a group consisting of a T-junction or tee connector, a compression connector, a solder connect connector, a National Pipe Tapered Threads (NPT) connector, and a National Pipe Straight Thread (NPS) connector.

In some examples, the second temperature is lower than the first temperature and the first fluid is the same as the second fluid. In some cases, the first and the second fluid may be water.

In some examples of the temperature-adjusting adapter system, the first connector further comprises a first connector adjustment port and the first end of the tube is connected at or near the first connector adjustment port.

In some embodiments, the adjustment mechanism comprises an adjustment valve, the adjustment valve selected from a group consisting of a ball valve, a disc valve, a disc-type valve, a fluid metering valve, and an adjustable flow valve. In some embodiments, at least a portion of the second fluid flows through the adjustment valve, the tube, and at least one check valve. In some embodiments, at least a portion of the second fluid flows through the second connector output port. In some embodiments, the adjustment mechanism further comprises one of a rotating handle, a rotating switch, a knob, a lever, and a dial. Further, the one of a rotating handle, a rotating switch, a knob, a lever, and a dial is coupled to the adjustment valve and utilized to adjust the flow of the first fluid through the adjustment valve.

In some examples of the temperature-adjusting adapter system, the adjustment mechanism is movable between an open position and a closed position. In some examples, a mixing ratio of the second fluid to the first fluid exiting the first connector output port in the open position comprises a maximum mixing ratio; and the mixing ratio of the second fluid to the first fluid exiting the first connector in the closed position comprises a minimum mixing ratio. In some embodiments, when the adjustment mechanism is moved to the open position, the mixing ratio of the second fluid to the first fluid exiting the first connector output port is at least about 50% or about 1:1. In some embodiments, when the adjustment mechanism is moved to the closed position, the mixing ratio of the second fluid to the first fluid exiting the first connector output port is about 0% or 0:1. In some embodiments, when the adjustment mechanism is moved to the closed position, all, or a majority of the second fluid entering the second connector input port flows through the second connector output port.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

The present disclosure relates generally to faucet hose systems. More specifically, but without limitation, the present disclosure relates to systems, methods and apparatuses for a modified faucet hose system that blends hot and cold water to minimize risk of scalding.

The word "exemplary" is used herein to mean "serving as an example, instance, or illustration." Any embodiment described herein as "exemplary" is not necessarily to be construed as preferred or advantageous over other embodiments.

In some cases, the water temperature from hot water supply lines may exceed a safety threshold, which may lead to scalding or burns, especially in children, who tend to have highly sensitive skin. In some cases, a user may be able to set a lower temperature at the hot water heater/tank to prevent scalding. In some circumstances, however, a hot water tank may need to be drained multiple times per day and cold water re-heated to reach the desired temperature, thus reducing the number of showers, dishwasher and/or laundry washing machine loads available per tank, causing significant delays for the users. In some cases, a user may also wish to have hot water above the safety threshold temperature in some appliances, for instance, a dish washer or washing machine. In such cases, the user may have to sacrifice main water heater temperature and energy efficiency in lieu of safety.

Aspects of the present disclosure relate to a modified faucet hose system and valve assembly configured to fit in-line with an existing faucet supply system. In some cases, the modified faucet hose system may comprise a temperature-adjusting adapter system (also referred to simply as, an adapter system) comprising one or more valves (e.g., check valves, such as one-way check valves; ball valve, such as standard or rotating ball valve; disc or disc-type valve). In some embodiments, the adapter system may be configured to couple to existing faucet hose connections with minimal or no plumbing modifications required. In some other cases, the adapter system may also comprise a partial or complete faucet hose replacement.

Figure 1:
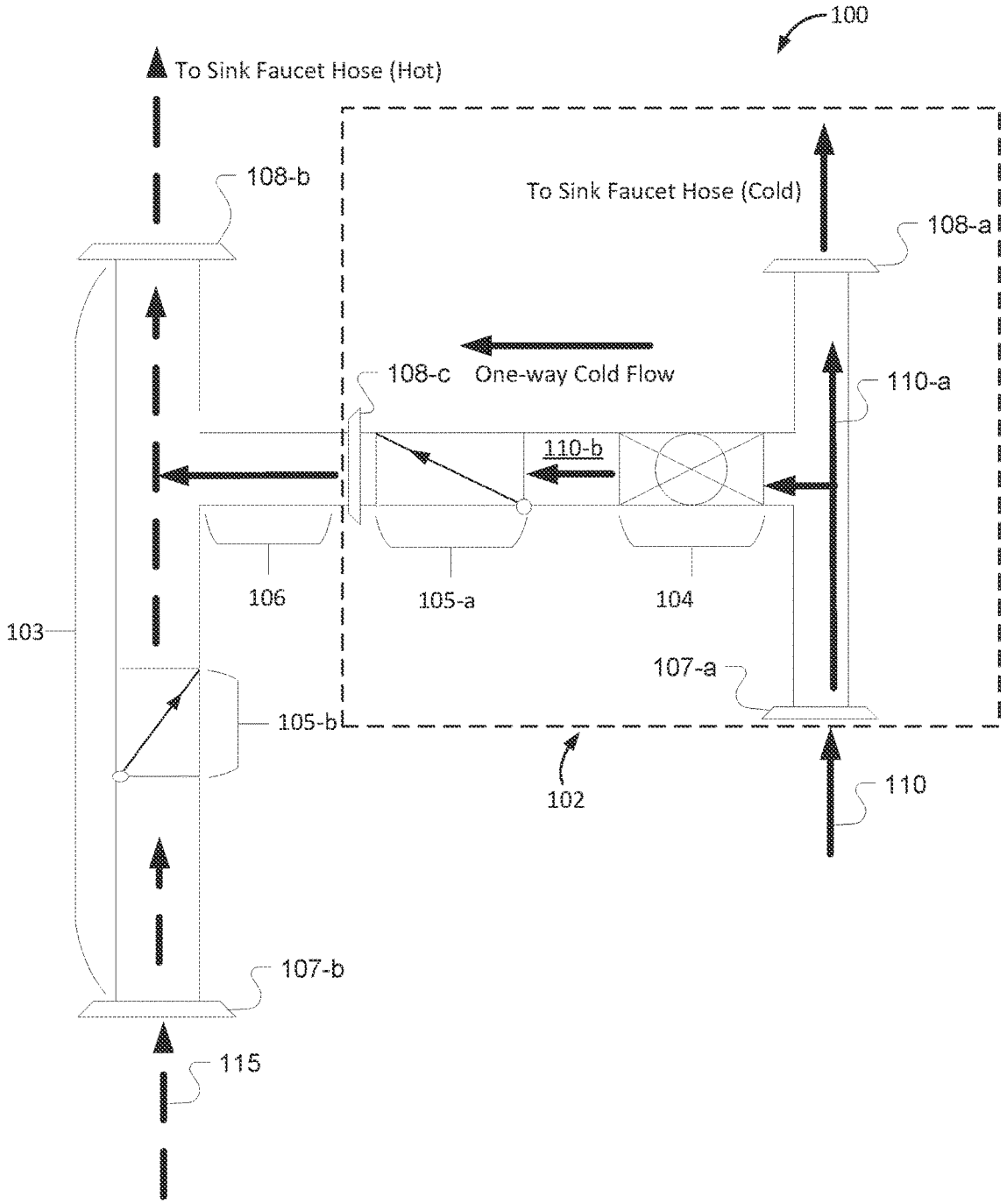
FIG. 1 illustrates a temperature-adjusting adapter system, according to various aspects of the disclosure.

FIG. 1 illustrates an example of a temperature-adjusting adapter system 100 (also referred to simply as, adapter system 100), according to various aspects of the disclosure. As shown, the adapter system 100 comprises a first connector (e.g., cold side tee connector 102) and a second connector (e.g., hot side tee connector 103). In some cases, the cold side tee connector 102 may comprise one or more valves, for example, a first valve, which may be a one-way check valve 105-*a* (i.e., for preventing backflow of hot water into the cold side) and a third valve, which may be an adjustment valve 104 (i.e., to adjust flow of cold water entering the hot side). In some examples, the adjustment valve 104 may comprise a disc or disc-type valve. In other cases, the adjustment valve 104 may comprise a ball valve (e.g., standard or rotating ball valve). As used herein, the term "backflow" or "back flow" may refer to unwanted flow of water or another fluid in a reverse (or undesired) direction. In reference to FIG. 1, for instance, backflow of hot water may refer to a situation when the hot water stream 115 flows to the right of the page (e.g., through hose 106). In some aspects, the one-way check valve 105-*a* may serve to prevent this hot water back flow from reaching the cold side of the adapter system 100, for instance, the cold side input connector 107-*a* or the cold side output connector 108-*a*. It is contemplated that one-way check valve 105-*a* may also be referred to as first valve 105, while adjustment valve 104 (e.g., ball or disc-type valve) may also be referred to as third valve 104 herein. In some cases, the cold side tee connector 102 may comprise a female connector 107-*a* at the water supply inlet, such as a compression connector, a solder connect connector, a National Pipe Taper (NPT) connector, and a National Pipe Straight (NPS) connector, to name a few non-limiting examples. In some cases, the hot side tee connector 103 may comprise at least one one-way check valve 105-*b* (i.e., for preventing backflow of cold water into hot water supply lines or pipes) and a female connector 107-*b*, such as a compression connector, a solder connect connector, an NPT connector, and a NPS connector, to name a few non-limiting examples. It is contemplated that the one-way check valve 105-*b* may also be referred to as second valve 105. In some examples, the connectors 107-*a* and 107-*b* of the cold side tee connector 102 and the hot side tee connector 103, respectively, may also be referred to as first connector input port and second connector input ports, respectively. It should be noted that other types of connectors than those listed above may be contemplated at the water supply inlet(s) (107-*a* & 107-*b*) in different embodiments. In some cases, the one-way check valve 105-*b* may help ensure that cold water from the cold-water supply line only mixes with hot water flowing to the hot side sink faucet (i.e., does not flow into or towards the female connector 107-*b* at the water supply inlet). In some cases, the one-way check valves 105 may be designed for 0.5 psi or less cracking pressure, although other pressure limits (e.g., 1 psi, 2 psi, etc.) are contemplated in different embodiments. Cracking pressure may refer to the minimum upstream pressure required for a check valve, such as a one-way check valve, to operate. Since check valves are designed for controlling fluid flow in one direction, the one-way check valves 105 (i.e., one-way check valve 105-*a*, 105-*b*) may only operate when the pressure of the incoming hot or cold-water stream from the supply lines is at least the specified cracking pressure.

In some embodiments, the cold side tee connector 102 may split a cold-water stream 110 flowing out of the cold supply line into two streams. A first cold-water stream 110-*a* may continue to directly flow, uninterrupted, through a first connector output port (e.g., also shown as output port 307-*d* in FIG. 3) to a cold-water faucet valve (not shown), while a second cold water stream 110-*b* may be diverted to flow through an adjustment port (e.g., shown as adjustment port 307-*g* in FIG. 3), the adjustment valve 104 (e.g., disc valve, disc-type valve, standard ball valve, rotating ball valve) and the first valve 105 (i.e., one-way check valve 105-*a*). In some cases, the second stream 110-*b* may flow through hose 106 (also referred to as tube 106) to the hot water side and mix with a hot water stream 115 from the hot water supply line. In such cases, the second cold water stream 110-*b* may mix with the incoming hot water stream 115 via a tee or junction connector/splitter (e.g., hot side tee connector 103). In some examples, the hot side tee connector 103 may also comprise an adjustment port (e.g., shown as adjustment port 307-*f* in FIG. 3). It is contemplated that the adjustment ports (e.g., adjustment ports 307-*f*, 307-*g*) may comprise openings in the connectors 102, 103 located proximal to the adjustment mechanism 104 and/or between the adjustment mechanism 104 and the first cold water stream 110-*a* and hot water stream 115, respectively. It is contemplated that the adjustment ports of the cold side tee connector 102 and the hot side connector 103 may also be referred to as first connector adjustment port and second connector adjustment port, respectively. As seen, the hose or tube 106 may be used to connect the cold and hot side tee connectors 102 and 103, respectively. For instance, a first end of the hose or tube 106 may be connected at or near the one-way check valve 105-*a*, while a second end of the hose or tube 106 may be connected to a junction, for instance, the second connector adjustment port of the hot side tee connector 103. In some embodiments, the hose 106 may be a braided steel hose, for instance. In some other cases, the hose 106 may be composed of any other applicable material, such as stainless steel, copper, chromed brass, reinforced plastic, or rubber to name a few non-limiting examples. It should be noted that the hose 106 may be shaped and sized to mate with both the hot and cold side tee connectors, or alternatively, the one-way check valve 105-*a* and the hot side tee connector 103. In some cases, the inner diameter of the hose 106 may be ½ or ⅜ inches, or less, although other hose diameters may be utilized in some embodiments. In some cases, the hose 106 may be flexible and permanently attached between the hot and cold side tee connectors.

Figure 3:
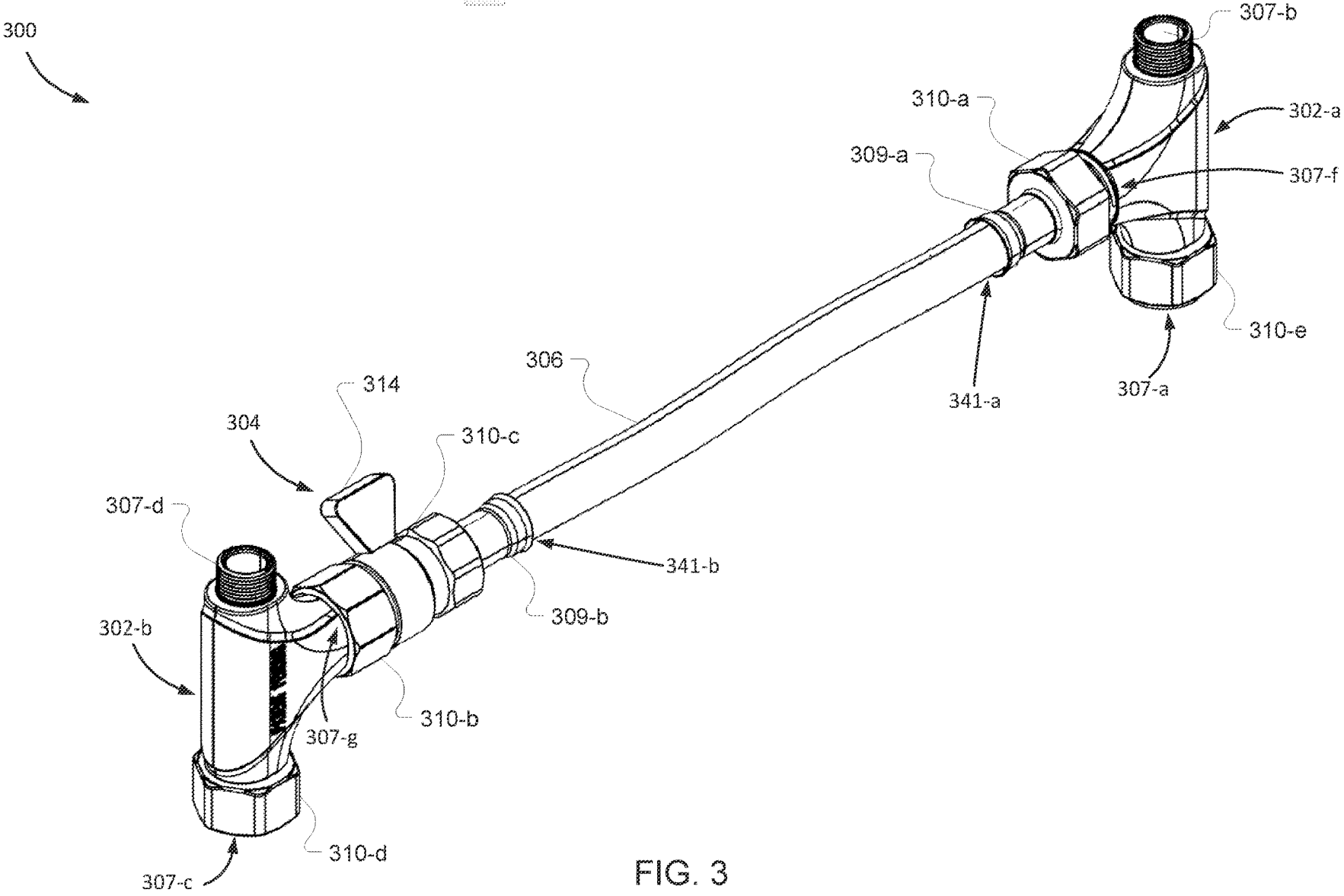
FIG. 3 illustrates a perspective view of a temperature-adjusting adapter system, according to various aspects of the disclosure.

Once mixed, the hot water stream 115 may be cooled down by the incoming second cold water stream 110-*b*. In some cases, the amount of cooling may be adjustable by varying the flow of the second cold water stream 110-*b* through the adjustment mechanism (e.g., adjustment valve 104, which may be a disc valve or a ball valve). It is contemplated that adjustment valve 104 may also be referred to as ball valve 104. In some cases, the ball valve 104 may be a standard ball valve, which may allow for up to a 50-50% mix of hot and cold water. Alternatively, the ball valve 104 may be a rotating ball valve comprising a "canyon" cut through it. Flow through the ball-valve 104 may be adjustable with a flathead screwdriver, for instance. However, other adjustment mechanisms (e.g., a lever, a detent adjustment pin mechanism, etc.) for varying flow are contemplated in different embodiments. In some other cases, the adjustment valve 104 may also be referred to as a disc or disc-type valve 104. The disc or disc-type valve 104 may be one of coupled to or integrated with the cold side tee connector 102 and may include one or more sliding or rotating discs. In some cases, flow through the disc valve 104 may be adjusted by rotating the disc (e.g., clockwise or anticlockwise). In some cases, the adjustment valve 104 may comprise a temperature adjustment lever (or alternatively, a temperature adjustment knob or dial), where the temperature adjustment lever is non-detachable and built-in to the side of the cold side tee connector 102 (optional) and attached to the adjustment valve assembly (e.g., ball valve or disc valve assembly). In other cases, the adjustment valve 104 comprises a temperature adjustment switch (e.g., a rotating switch) attached to the adjustment valve assembly. In yet other cases, the adjustment valve comprises a temperature adjustment handle (e.g., a rotating handle) attached to the adjustment valve assembly (e.g., disc or disc-type valve assembly). FIG. 3 depicts one non-limiting example of an adjustment handle 314 (e.g., a rotating handle) of an adjustment mechanism 304. In some cases, a seal may be utilized to secure the knob or dial in place, which may alleviate leakage associated with the adjustment lever. The knob or dial may protrude from a side of the cold side tee connector 102, which may allow a user to access it and adjust the ratio of hot-cold water mixing. In other cases, the adjustment mechanism (e.g., adjustment mechanism 304 in FIG. 3) may be secured at one end to a first connector adjustment port (e.g., port 307-*g*) of the cold side tee connector using a nut (e.g., nut 310-*b*) and at another end to the hose or tube using one or more of a nut (e.g., nut 310-*c*), a crimp (e.g., crimp 309-*b*), a ferrule (e.g., shown as ferrule 1731-*a* in FIG. 17), and/or a barbed hose fitting (e.g., shown as barbed hose fitting 1733-*a* in FIG. 17). As seen in FIG. 17, the barbed hose fitting 1733-*a* may comprise one or more ridges or bumps for gripping an inside diameter of a tube, which may help provide a sealed and secure connection between the adjustment mechanism 1704 and the tube.

Returning now to FIG. 1, in order to prevent backflow, such as hot water mixing into the cold-water side, the first valve 105 (e.g., one-way check valve 105-*a*) may be built into the cold side tee connector 103 to only allow cold water to flow to the hot side, but not vice-versa. In some cases, another one-way check valve 105-*b* (i.e., second valve 105) may be installed or built into the hot side tee connector 103, which may serve to prevent cold water from inadvertently entering the system of hot water pipes and cooling the hot water being supplied to other fixtures in the household or building. It should be noted that, the locations of the one-way check valves 105 in FIG. 1 is not intended to be limiting. For instance, in some examples, both the one-way check valves 105 may be located on the hot side and one of coupled to or integrated with the hot side tee connector 103.

In some embodiments, at the water inlets (shown as cold-water stream 110 and hot water stream 115), the cold and hot side tee connectors 102 and 103, respectively, may connect to incoming supply pipes (not shown) of the household/building. In some examples, the cold and hot side tee connectors may comprise a ⅜-inch female, compression type, threaded connector (e.g., female connectors 107-*a* and 107-*b*) at the inlets and a ⅜-inch male compression-type, threaded connector (e.g., male connectors 108-*a*, 108-*b*, 108-*c*) at the outlet. It is contemplated that the inlets of the cold and hot side tee connectors may also be referred to as connector input ports (e.g., first connector input port, second connector input port, shown as connector input ports 307-*c* and 307-*a* in FIG. 3). In some cases, the male compression-type threaded connector (e.g., male connector 108-*a*) at the outlets may be configured to re-attach to existing faucet supply hoses. It is contemplated that the outlets of the cold and hot side tee connectors may also be referred to as connector output ports (e.g., first connector output port, second connector output port, shown as connector output ports 307-*d* and 307-*b* in FIG. 3). Furthermore, the male connector 108-*c*, which may be optional, at the end of the one-way check valve 105-*a* may be shaped and sized to receive or mate with the hose or tube 106 connecting the cold and hot side tee connectors. In some examples, this male connector 108-*c* may serve as the first connector adjustment port. In some cases, the hose 106 may be built-in and permanently attached to the hot and cold side tee connectors 103 and 102, respectively. For instance, the hose 106 may be unitary (i.e., integrated) with or coupled (i.e., connecting two separate & distinct devices) to the cold and hot side tee connectors 102 and 103. Thus, in some examples, the temperature adjusting adapter system 100 may be sold as a single piece, where the hose 106 may be built in and non-detachable from the valve assembly (i.e., one-wave check valves 105-*a* and/or 105-*b*). Additionally, it should be noted, that the connector sizes and configurations (e.g., male-type, female-type) listed above are merely examples, and not intended to be limiting. For instance, connectors having different sizes (e.g., ½ inch, ⅜ inch, etc.) and/or compression types (e.g., male, female) may be utilized in different embodiments. In some cases, one or more of the connectors may be replaced with non-threaded connectors. In some examples, the connectors may be 7/16-inch compression connectors, or ½ inch×½ inch Female Iron Pipe (FIP) threaded connectors, or otherwise. In this way, aspects of the present disclosure may be used with a wide variety of faucet supply hoses.

In some embodiments, the connectors and/or hoses may be color coded (e.g., red for hot side, blue for cold side). Further, the adjustment mechanism (i.e., adjustment valve 104 for adjusting flow, maybe a ball valve or a disc valve) may also comprise temperature indicators to allow a user to easily identify and adjust the level of hot and cold mixing. For instance, in one non-limiting example, the adjustment valve 104 may comprise '+' and '−' symbols along the direction the lever, dial, or knob travels, indicating maximum and minimum hot and cold mixing, respectively. Alternatively, the adjustment valve 104 (also referred to as a flow adjust valve 104) may comprise a colored gradient (e.g., blue to red colored gradient) along the direction of travel to indicate the level of hot and cold-water mixing. Further, the adjustment lever or knob of the adjustment valve 104 may be designed to face outward and/or be clearly visible to a user, for instance, when installed under a sink. In some cases, the adjustment valve 104 may comprise a notch (not shown) for receiving a screwdriver head, or a lever, which may allow a user to set the mixing ratio of the cold and hot streams 110 and 115.

Figure 2:
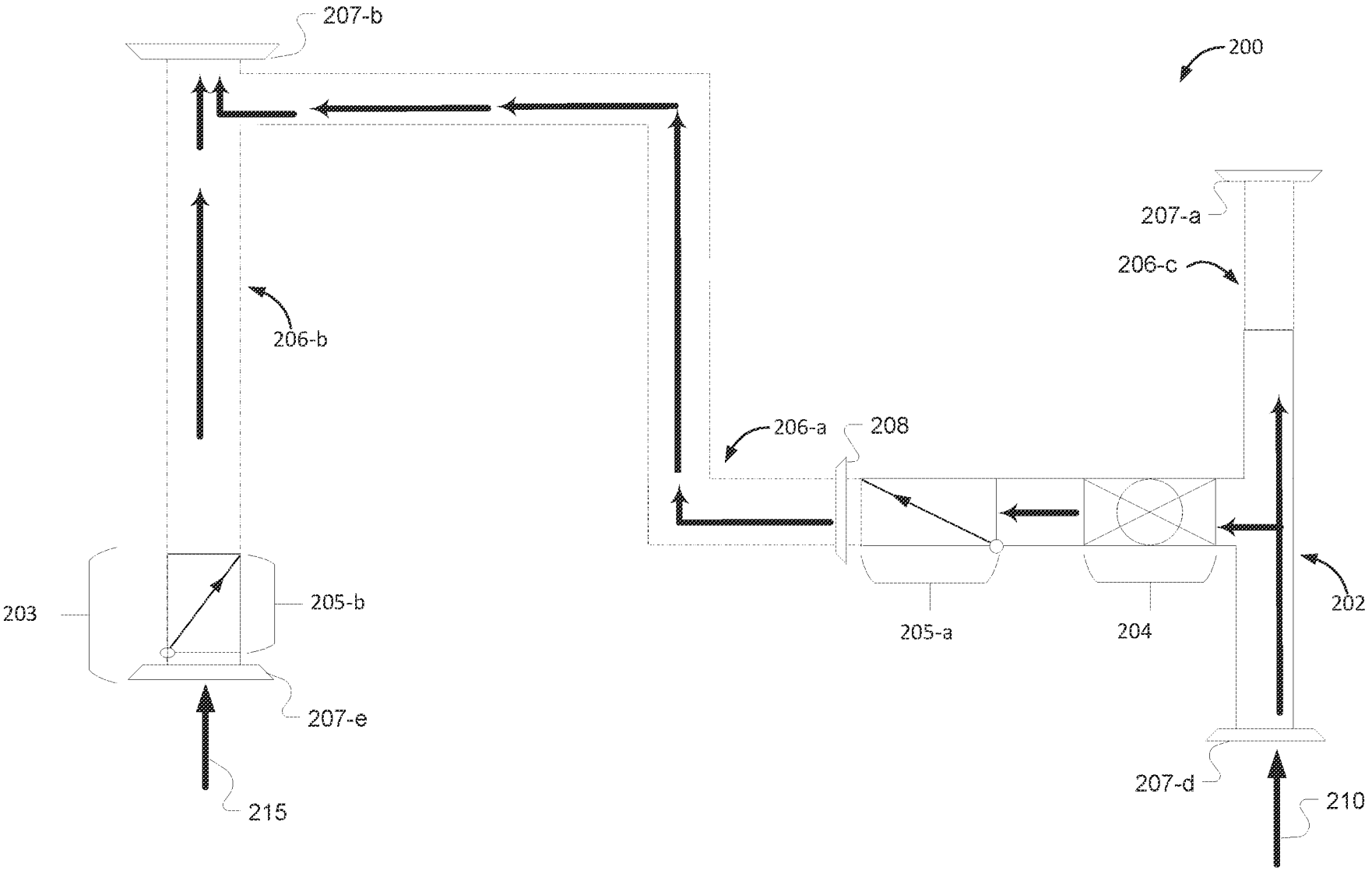
FIG. 2 illustrates a temperature-adjusting adapter system, according to various aspects of the disclosure.

FIG. 2 illustrates an example of a temperature-adjusting adapter system 200, according to an alternate embodiment of the disclosure. In some cases, the temperature-adjusting adapter system 200 may be configured to attach directly onto a sink faucet valve assembly (i.e., at or near connectors 207-*a* and/or 207-*b*) at both the hot and cold sides, as opposed to the temperature-adjusting adapter system 100 in FIG. 1 which is configured to re-attach to existing faucet supply hoses. In this way, the adapter system 200 illustrated in FIG. 2 may be configured to replace an existing faucet hose system partially or completely. In some examples, the adapter system 200 implements one or more aspects of the adapter systems described herein, including at least adapter systems 100 and/or 300. In some cases, the temperature-adjusting adapter system 200 may utilize one connector (e.g., first connector 202) having three ports, namely, a first connector input port, a first connector output port, and a first connector adjustment port, and another connector (e.g., second connector 203) having two ports, namely, a second connector input port, and a second connector output or adjustment port. In the example shown, a spliced hose having two branches (i.e., hose 206-*a* and hose 206-*b*) is coupled to the connector 207-*b*, where hose 206-*b* is coupled to the second connector 203, and hose 206-*a* is coupled to the first connector 202. In some cases, the hoses 206-*a* and 206-*b* with the spliced connection may be installed at or near (e.g., just below) a sink faucet valve, for example, on the hot side.

As shown, the adapter system 200 comprises a first connector 202 (also referred to as, a cold side tee connector 202) and a second connector 203 (also referred to as, a hot side tee connector 203). In some cases, the cold side tee connector 202 may comprise one or more valves, for example, a first valve 205, which may be a one-way check valve 205-*a* (i.e., for preventing backflow of hot water into the cold side) and a third valve 204, which may be an adjustment valve 204 (i.e., to adjust flow of cold water feeding over to the hot side). In some cases, the adjustment valve 204 comprises a disc or disc-type valve. Alternatively, the adjustment valve 204 comprises a ball valve (e.g., standard or rotating ball valve) or other valve type provided similar functionality. In some cases, the cold side tee connector 202 may further comprise a female connector 207-*d*, which may be an example of a compression connector, a solder connect connector, an NPT connector, and a NPS connector, to name a few non-limiting examples. In some cases, the hot side tee connector 203 may also comprise at least one one-way check valve 205-*b* (i.e., for preventing backflow of cold water into hot water supply lines or pipes) and a female connector 207-*e*, which may be an example of a compression connector, a solder connect connector, an NPT connector, and a NPS connector, to name a few non-limiting examples. In some cases, the one-wave check valve 205-*b* may help ensure that cold water 210 from the cold-water supply line only mixes with hot water 215 flowing to the sink faucet (i.e., towards connector 207-*b*). It is contemplated that the one-way check valve 205-*b* may also be referred to as second valve 105. In some examples, the connectors 207-*a* and 207-*b* of the cold side tee connector 202 and the hot side tee connector 203, respectively, may also be referred to as first connector input port and second connector input ports, respectively. In some cases, the one-way check valves 205 may be designed for 0.5 psi or less cracking pressure, although other cracking pressure limits (e.g., less than 1 psi, less than 2 psi, less than 3 psi, less than 10 psi, etc.) are contemplated in different embodiments. Further, as shown, the one-way check valve 205-*a* of the connector 202 may also comprise a built-in male compression connector 208 (optional) for coupling the one-way check valve 205-*a* to hose 206-*a*. While not shown, the one-way check valve 205-*b* of the connector 203 may also comprise an optional male compression connector for coupling the connector 203 to hose 206-*b*. It is contemplated that the built-in male compression connector 208 and the optional male compression connectors for coupling the connector 203 to hose 206-*b* may also be referred to as first and second connector adjustment ports, respectively. FIG. 3 depicts an example of a first connector (e.g., connector 302-*b*) having a first connector adjustment port (e.g., port 307-*g*) and a second connector (e.g., connector 302-*a*) having a second connector adjustment port (e.g., port 307-*f*).

As shown, the faucet hose replacement system in FIG. 2 may comprise one or more hoses 206 (e.g., hose 206-*a*, hose 206-*b*, hose 206-*c*) coupled to the cold side tee connector 202 and/or hot side tee connector 203. In some cases, a female connector 207-*b* (also referred to as a second connector output port, shown as port 307-*b* in FIG. 3), such as a ½ inch female connector, may be configured to couple to a sink faucet valve assembly (not shown) at the hot water side. Further, another female connector 207-*a* (also referred to as a first connector output port, shown as port 307-*d* in FIG. 3) may be configured to couple to a cold-water side sink faucet valve assembly (not shown). In some cases, hoses 206-*a* and 206-*b* may be used to couple the cold side tee connector 202 and the hot side tee connector 203, respectively, to the connector 207-*b*. In some embodiments, the hoses 206-*a* and 206-*b* may be joined near a top (i.e., closer to the hot water side sink faucet valve assembly) before coupling to the connector 207-*b*. In this way, when looking down from the connector 207-*b* (i.e., away from the hot water side faucet valve assembly), the hoses 206-*a* and 206-*b* may appear as a single or unitary hose with separate hot/cold branches. In some cases, the inner diameter of the hoses 206 may be the same (or approximately the same) as the inner diameter of the hot and cold side tee connectors, for instance, ⅜ inches. In some cases, a hose 206-*c* may also be used to couple the cold side tee connector 202 to the female connector 207-*a*, for instance, the first connector adjustment port to the second connector adjustment port. The female connector 207-*a* (also referred to as first connector output port) may be in fluid communication with the cold-water side sink faucet assembly. In such cases, only cold water may flow through hose 206-*c* and connector 207-*a*, while hot (or a mixture of hot and cold) water may flow through connector 207-*b* (also referred to as second connector output port). It should be noted that, the hoses 206 may be unitary with or coupled to the cold and hot side tee connectors 202 and 203, as well as the connectors 207-*a* and 207-*b*. Thus, the temperature-adjusting adapter system 200 may be sold as a single piece wherein the hoses or tubes 206 may be built in and non-detachable from the valve assembly (i.e., first and second valves 205, for instance, one-way check valves 205-*a* and/or 205-*b*). In some cases, the hoses may be ⅜-inch braided steel hoses, although other types of hoses with different dimensions or composed of different materials, are contemplated in other embodiments. In some cases, the hoses may be of different lengths (e.g., hose 206-*a* is 30 inches long, while hoses 206-*b* and 206-*c* are 20 inches long). Alternatively, the hoses 206 may be of the same length.

In some embodiments, the connectors and/or hoses may be color coded (e.g., red for hot side, blue for cold side). Further, the adjustment valve 204 (also referred to as a flow adjust valve) may also comprise temperature indicators (e.g., hot, and cold indicators) to allow a user to easily identify and adjust the level of hot and cold mixing. For instance, the flow adjust valve 204 may comprise '+' and '−' symbols along the direction of travel indicating maximum and minimum hot and cold mixing, respectively. Alternatively, the flow adjust valve 204 may comprise a colored gradient (e.g., blue to red colored gradient) along the direction of travel to indicate the level of hot and cold-water mixing. In some cases, the adjustment valve 204 may comprise a notch (not shown) for receiving a screwdriver head, or a lever, which may allow a user to set mixing ratio of the cold and hot water streams 210 and 215.

As noted above, the one-way check valves 205-*a* and 205-*b* may be designed for 1 psi or less cracking pressure, although other cracking pressure limits (e.g., 2 psi or less, 3 psi or less, etc.) are contemplated in different embodiments. In some cases, the adapter systems described throughout this disclosure may be configured to fit existing supply pipes with either ⅜ inch or ½ inch connections. In some cases, each tee connector and valve assembly may be designed to be compact enough to minimize interference with the standard space between supply pipes. Further, the adjustment lever/knob/dial of the adjustment valve 204 (e.g., ball valve, disc or disc-type valve) may be designed to face outward and/or be clearly visible to a user once installed, for instance, under a bathroom sink or cabinet.

It should be noted that all terms and phrases associated with and described in relation to FIGS. 1 and 2 above also apply to the same and/or similar features described in relation to the figures below, including at least FIGS. 3, 4, and 10-12, and 15-17.

FIG. 3 illustrates a perspective view of a temperature-adjusting adapter system 300, according to various aspects of the disclosure. The temperature-adjusting adapter system 300 may be similar or substantially similar to one or more of the temperature-adjusting adapter system(s) 100 and/or 200 previously described in relation to FIGS. 1 and/or 2, respectively. As seen, the temperature-adjusting adapter system 300 (also referred to as adapter system 300) comprises a first connector 302-*a* for coupling to a first fluid inlet (e.g., a hot water inlet of a faucet or tap, shown as hot water stream 115 in FIG. 1) and a second connector 302-*b* for coupling to a second fluid inlet (e.g., a cold-water inlet, shown as cold-water stream 110 in FIG. 1). Each of the connectors 302 may include a plurality of ports 307. For instance, the first connector 302-*a* may include a first port 307-*a* (e.g., a first connector input port), a second port 307-*b* (e.g., a first connector output port), and a third port 307-*f* (e.g., a first connector adjustment port). Further, the second connector 302-*b* includes a first port 307-*c* (e.g., a second connector input port), a second port 307-*d* (e.g., a second connector output port), and a third port 307-*g* (e.g., a second connector adjustment port). In some examples, the first fluid inlet may receive water (or another fluid) at a first temperature and the second fluid inlet may receive water (or another fluid) at a second temperature. As illustrated, a tube or hose 306 (e.g., a steel or stainless-steel braided hose, a rubber hose, a plastic or polymer pipe, etc.) may be coupled between the ports 307-*f* and 307-*g* of the first and second connectors 302-*a* and 302-*b*, respectively. In some examples, the adapter system 300 may further comprise an adjustment mechanism 304, for instance, a mixing or adjustment valve positioned between the ports 307-*f* and 307-*g* of the two connectors 302. The adjustment mechanism 304 may be one of coupled and integrated at or near one of the first end and the second end of the tube. In this example, the adjustment mechanism 304 is one of coupled and integrated near the second end 341-*b* of the tube 306, but this illustration is in no way intended to be limiting. For example, in some cases, the adjustment mechanism 304 may be coupled or integrated at or near the first end of the tube 306. Some non-limiting examples of mixing or adjustment valves may include a disc or disc-type valve, a ball valve (e.g., a standard ball valve, a rotating ball valve), a tempering valve (e.g., for mixing hot and cold water to deliver hot or warm water at a constant temperature, may include a temperature sensitive element that adjusts the mixing ratio depending on the temperature of the incoming water), a thermostatic mixing valve (e.g., for mixing hot and cold water to produce constant temperature water in the presence of variable pressures and/or temperatures at the two input ports 307-*c* and 307-*a*), a fluid metering valve (e.g., a valve for varying flow rate and/or fluid volume), an adjustable flow valve, and a single handle mixer valve. In some examples, the adjustment mechanism 304 may include an adjustment handle or dial 314, which may allow a user to control the amount of water or fluid flowing from the connector 302-*b* to the connector 302-*a*, for instance, from the port 307-*g* to the port 307-*f*. Typically, the temperature of the fluid (e.g., water) at the output port 307-*d* of the connector 302-*b* may be equal (or roughly equal) to the temperature at the input port 307-*c*. Further, the temperature of the fluid at the output port 307-*b* of the connector 302-*a* may be based in part on the amount of fluid flowing from the connector 302-*b* to the connector 302-*a*. In some cases, the adjustment mechanism 304 may be used to adjust a mixing ratio of the fluid(s) flowing from the output port 307-*b* of the connector 302-*a*. For instance, the adjustment mechanism 304 may be used to adjust a mixing ratio (e.g., ratio of cold to hot water) of the water exiting the port 307-*b*. Depending on the type of adjustment mechanism 304 utilized, a user may be able to adjust the mixing ratio or percentage from anywhere between 0 and 100%. In one non-limiting example, the adjustment mechanism 304 may include a standard ball valve, which may allow for up to a 50-50% mix (i.e., 1:1 ratio) of hot and cold-water flow from the output port 307-*b*. In other cases, the adjustment mechanism 304 may comprise a rotating ball valve (e.g., a ball valve comprising a slot or canyon cut through it), which may allow for a mixing ratio from anywhere between 100% cold to 100% hot. In yet other cases, the adjustment mechanism 304 comprises a disc or disc-type valve having one or more rotating or sliding discs. Flow through the disc or disc-type valve may be adjusted by rotating the disc(s) clockwise or counterclockwise, for instance. In some examples, the adjustment mechanism 304 is movable between an open position and a closed position. Further, a mixing ratio of the second fluid (e.g., cold water, shown as cold-water stream 110 in FIG. 1) to the first fluid (e.g., hot water, shown as hot water stream 115 in FIG. 1) exiting the output port (e.g., port 307-*b*) of the first connector in the open position comprises a maximum mixing ratio (e.g., at least about 50% cold, about 100% cold, to name two non-limiting examples). Similarly, the mixing ratio of the second fluid (e.g., cold water) to the first fluid (e.g., hot water) exiting the output port of the first connector in the closed position comprises a minimum mixing ratio (e.g., about 0% or only hot water, a maximum of about 10%, at or below 20%, to name a few non-limiting examples). In some instances, when the adjustment mechanism is moved to the closed position, all, or a majority (e.g., at least 95% in volume, at least 99% in volume, at least 90% in volume) of the cold water entering the input port 307-*c* of the connector 302-*b* flows through the output port of the connector 302-*b*.

In some examples, the adapter system 300 may be designed to be positioned between existing incoming supply lines (e.g., hot and cold-water supply lines) and faucet(s) of a faucet hose system. For instance, the ports 307-*a* and 307-*c* may be shaped and sized to couple to incoming hot and cold-water supply lines, respectively, of a faucet hose system. Further, each of the ports 307-*b* and 307-*d* may be shaped and sized to couple to an input end or hose system of a faucet. In some cases, the faucet hose system may comprise a single faucet having an output end and two input ends (or hose systems) coupled to hot/cold water supply lines. The output end of the single faucet may be connected to the input ends (or hose systems), which may allow the faucet to provide both hot and cold water. In some cases, the single faucet may have individual hot/cold water controls, or alternatively, a single dial that can be moved between fully hot and fully cold. In some cases, such single faucet systems may be prone to scalding, for instance, if a user only turns the hot water control (e.g., in a faucet having dual controls, one for hot and one for cold), the user turns the single dial to the fully hot setting (e.g., in a faucet having a single dial), or if is there a delay in the mixing of hot and cold water, to name a few non-limiting examples. To overcome such deficiencies, the adapter system 300 of the present disclosure may be configured to be positioned between the input ends (or hose systems) of the faucet hose system and the incoming hot/cold water supply lines from the building. In this way, when a user turns on the faucet, for instance, to fully hot, the temperature of the water exiting the output end of the faucet may be cooled down significantly to prevent scalding.

As illustrated, in some cases, a nut 310-*d* (or another attachment mechanism) may be used to couple the port 307-*c* to a fluid inlet (e.g., cold water inlet). Further, a nut 310-*e* (or another attachment mechanism) may be used to couple the port 307-*a* of the connector 302-*a* to another fluid inlet (e.g., hot water inlet). Further, a nut 310-*a* and a crimp 309-*a* may be used to couple a first end 341-*a* of the hose or tube 306 at or near the port 307-*f* of the connector 302-*a*, while another nut 310-*c* and crimp 309-*b* may be used to couple a second, opposing end 341-*b* of the tube or hose 306 at or near the adjustment mechanism 304. As illustrated, the tube 306 includes an outer surface having an outer diameter, and the one or more crimps (e.g., crimps 309-*a*, 309-*b*) couple to the outer surface of the tube 306. In some cases, the outer diameter of the tube 306 may be shaped and sized to be received within (or alternatively, couple to) an inner diameter of the crimps 309. In some instances, the outer diameter of the tube may be at or around ½ inch, at or around ⅜ inch, at around 7/16 inch, to name a few non-limiting examples. In such cases, the inner diameter of the crimps 309 may be at least (or slightly greater than) ½ inch, or ⅜ inch, or 7/16 inch, for instance. In this way, the nuts 310-*a* and 310-*c*, crimps 309-*a* and 309-*b*, ferrules (optional, shown as ferrules 1731-*a* and 1731-*b* in FIG. 17), washers (e.g., shown as washers 1716 in FIG. 17), and/or barbed to hose fittings (e.g., shown as barbed to hose fittings 1733-*a*, 1733-*b*, 1733-*c*) may be used to one of couple and integrate a first valve (e.g., one-way check valve 105-*a* in FIG. 1, one-way check valve 1705 in FIG. 17), the tube 306, and the adjustment mechanism 304. In some cases, the adjustment mechanism 304 may be secured to the port 307-*g* using a nut 310-*b*. It should be noted that other coupling/securing mechanisms known in the art may be utilized in different embodiments, and the examples listed herein are not intended to be limiting. It is contemplated that the adapter systems described herein, including at least adapter systems 100 and/or 300 may be designed to be detachable. For instance, the first connector 302-*a*, the second connector 302-*b*, the adjustment mechanism 304, and the tube 306 may be designed to be disconnected and subsequently reconnected by a user. In some aspects, a detachable adapter system may allow a greater level of flexibility to a user. For instance, a detachable adapter system may enable a user to attach a longer or a shorter hose (e.g., hose 306), if desired. In other cases, the adapter system of the present disclosure may be designed to be non-detachable. In such cases, a user may not be able to dismantle (or disassemble) the adapter system (e.g., adapter system 100, adapter system 300) into its individual components.

Figure 4:
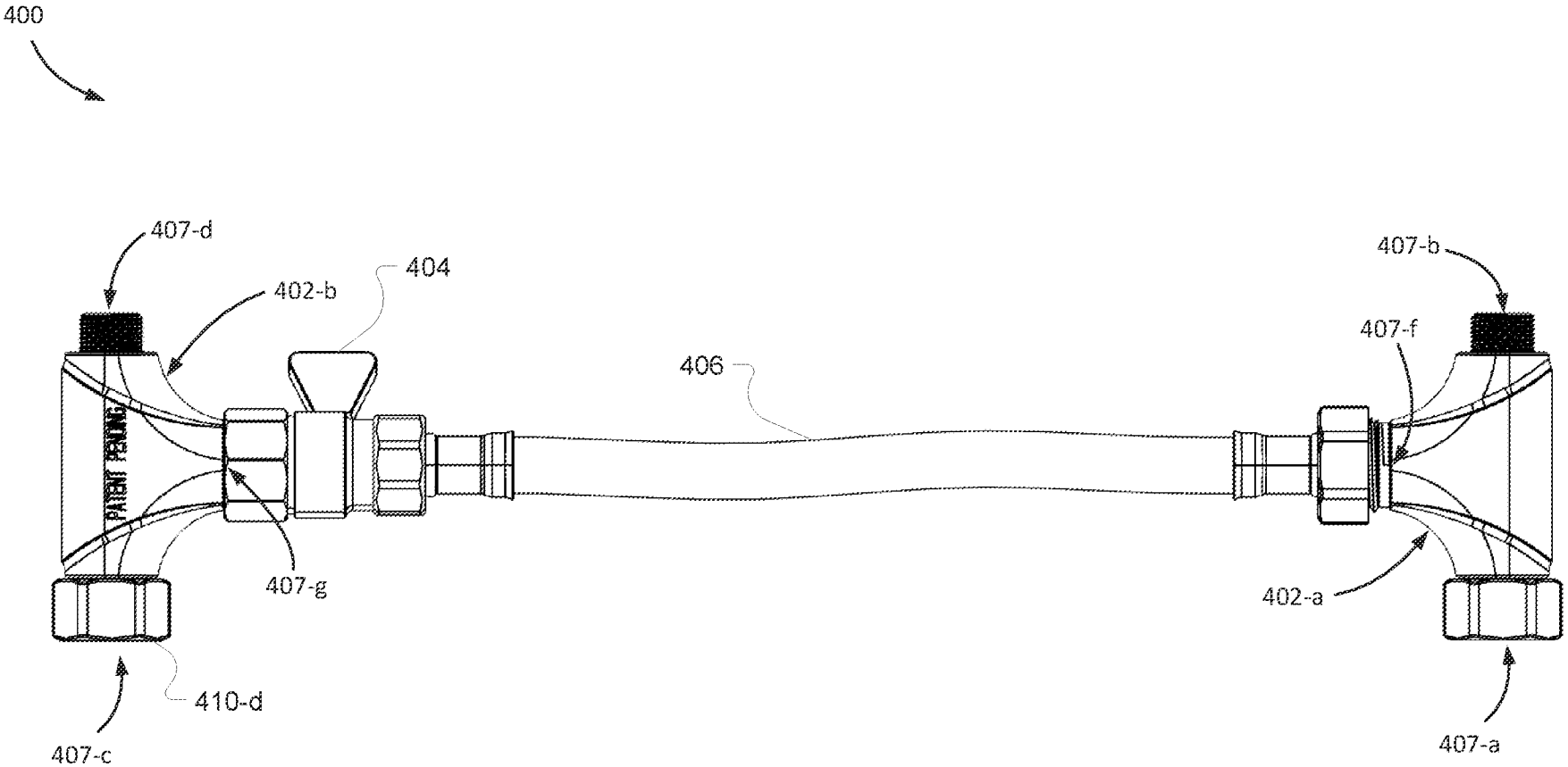
FIG. 4 illustrates a side view of the temperature-adjusting adapter system in FIG. 3, in accordance with one or more implementations.

FIG. 4 illustrates a side view of a temperature-adjusting adapter system 400 (or simply adapter system 400), according to various aspects of the disclosure. The adapter system 400 may be similar or substantially similar to the adapter system 300 previously described in relation to FIG. 3.

As seen, the adapter system 400 includes a first connector 402-*a* and a second connector 402-*b*, which may be examples of tee junction/splitter connectors. Each of the connectors 402 may include a plurality of ports 407. For instance, the first connector 402-*a* may include a first port 407-*a* (e.g., an input port configured to be coupled to an incoming supply line of a building), a second port 407-*b* (e.g., an output port configured to be coupled to an input end or hose system of a faucet), and a third port 407-*f* (e.g., an adjustment port). Further, the second connector 402-*b* includes a first port 407-*c* (e.g., an input port configured to be coupled to an incoming supply line of a building), a second port 407-*d* (e.g., an output port configured to be coupled to an input end or hose system of a faucet), and a third port 407-*g* (e.g., an adjustment port). In some examples, the incoming supply line coupled to the first connector 402-*a* may provide water (or another fluid) at a different temperature than the incoming supply line coupled to the second connector 402-*b*. As illustrated, a tube 406 (e.g., a hose, such as a stainless-steel braided hose, a rubber hose, a plastic or polymer pipe, etc.) may be coupled between the adjustment ports (e.g., ports 407-*f* and 407-*g*) of the first and second connectors 402-*a* and 402-*b*. In some examples, the adapter system 400 may further comprise an adjustment mechanism 404 having a ball valve (or another mixing valve, such as a disc or disc-type valve, a flow adjust valve, a fluid metering valve) positioned between the ports 407-*f* and 407-*g* of the two connectors 402.

Figure 5:
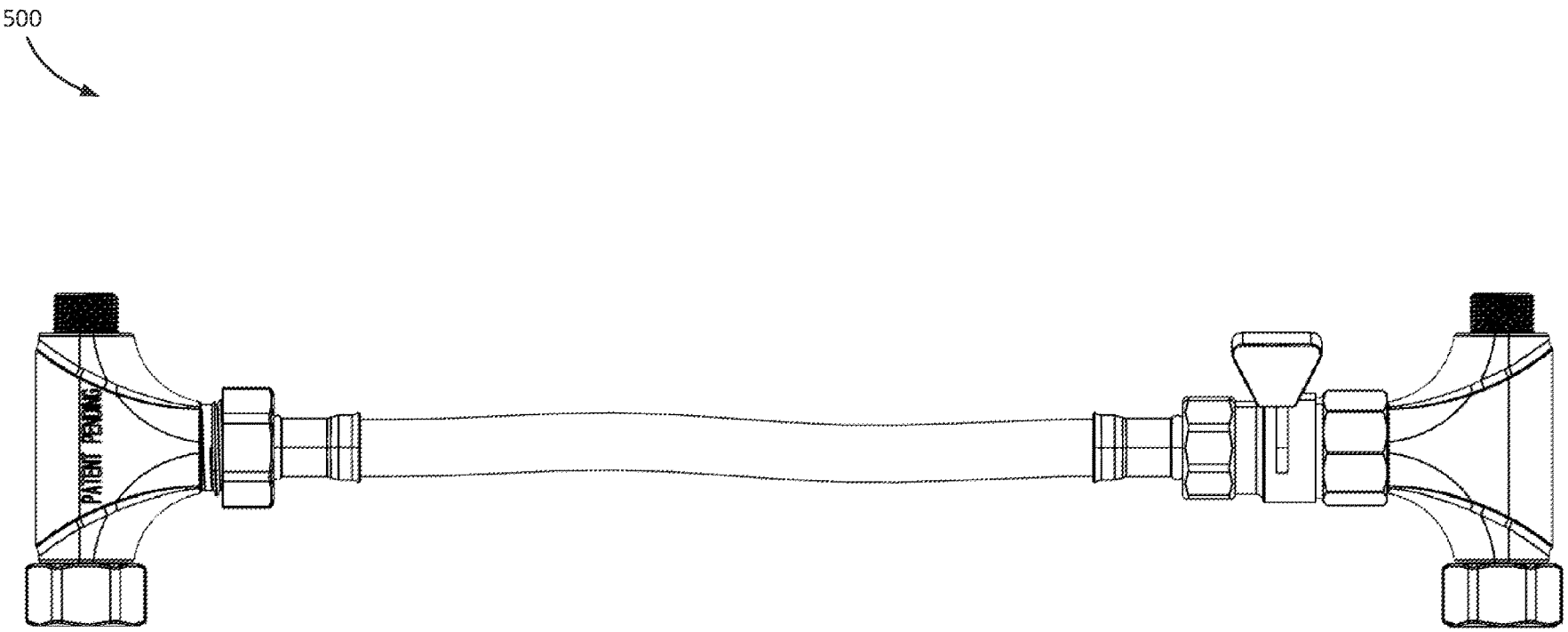
FIG. 5 illustrates another side view of the temperature-adjusting adapter system in FIG. 3, in accordance with one or more implementations.

FIG. 5 illustrates another side view of a temperature-adjusting adapter system 500 (or simply, adapter system 500), according to various aspects of the disclosure. The temperature-adjusting adapter system 500 may be similar or substantially similar to any of the adapter systems described herein, including at least adapter system(s) 300 and/or 400, previously described in relation to FIGS. 3 and/or 4.

Figure 6:
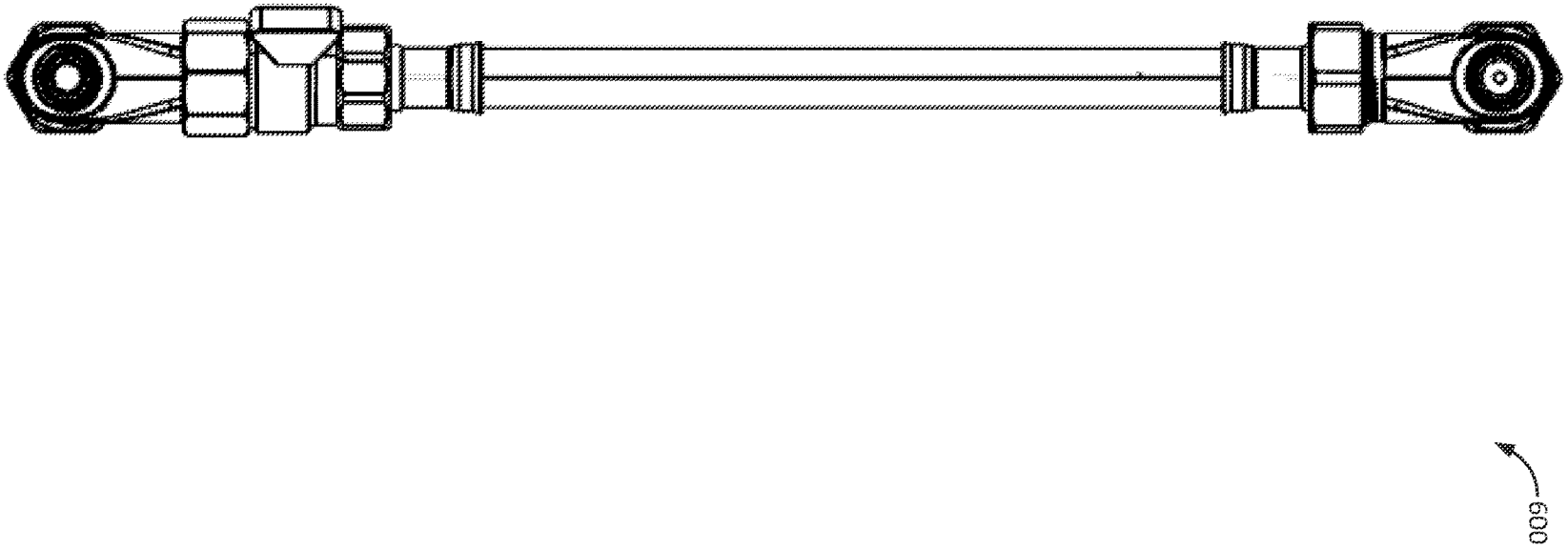
FIG. 6 illustrates a top view of the temperature-adjusting adapter system in FIG. 3, in accordance with one or more implementations.

FIG. 6 illustrates a top view of a temperature-adjusting adapter system 600, according to various aspects of the disclosure. In some examples, the temperature-adjusting adapter system 600 implements one or more aspects of the temperature-adjusting adapter system 300, described above in relation to FIG. 3.

Figure 7:
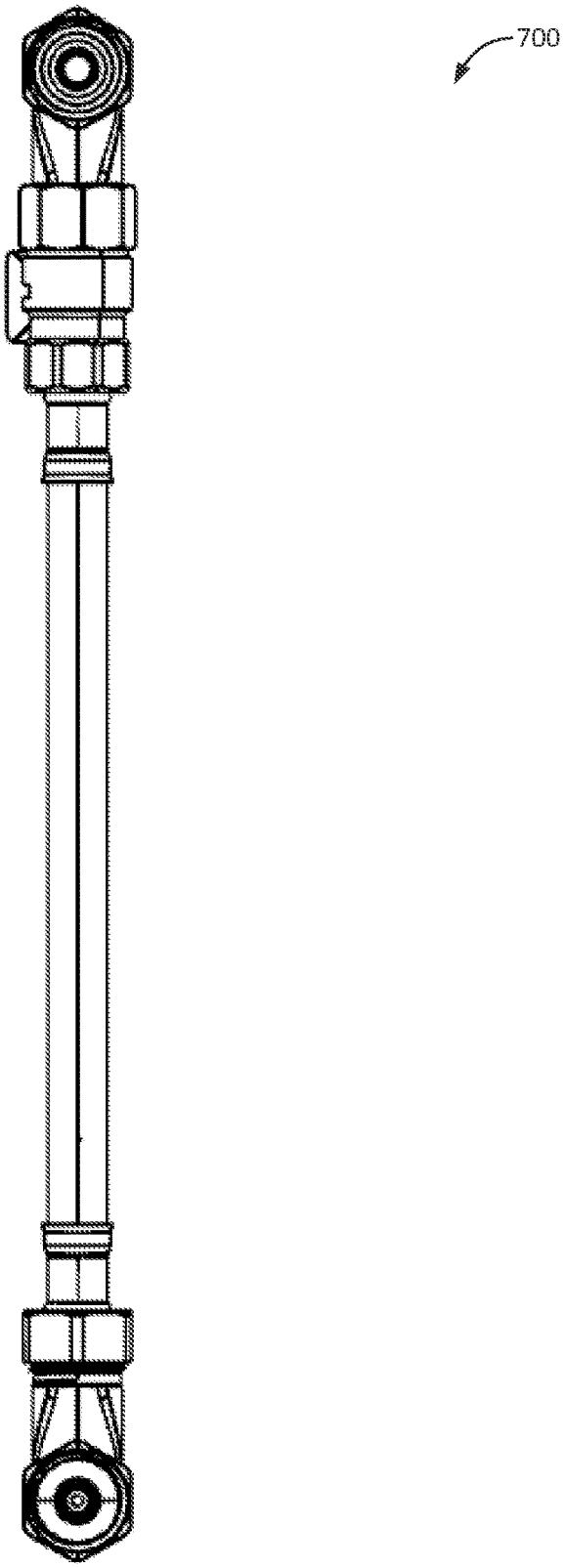
FIG. 7 illustrates a bottom view of the temperature-adjusting adapter system in FIG. 3, in accordance with one or more implementations.

FIG. 7 illustrates a bottom view of a temperature-adjusting adapter system 700, according to various aspects of the disclosure. In some examples, the temperature-adjusting adapter system 700 implements one or more aspects of the temperature-adjusting adapter system 300, described above in relation to FIG. 3.

Figure 8:
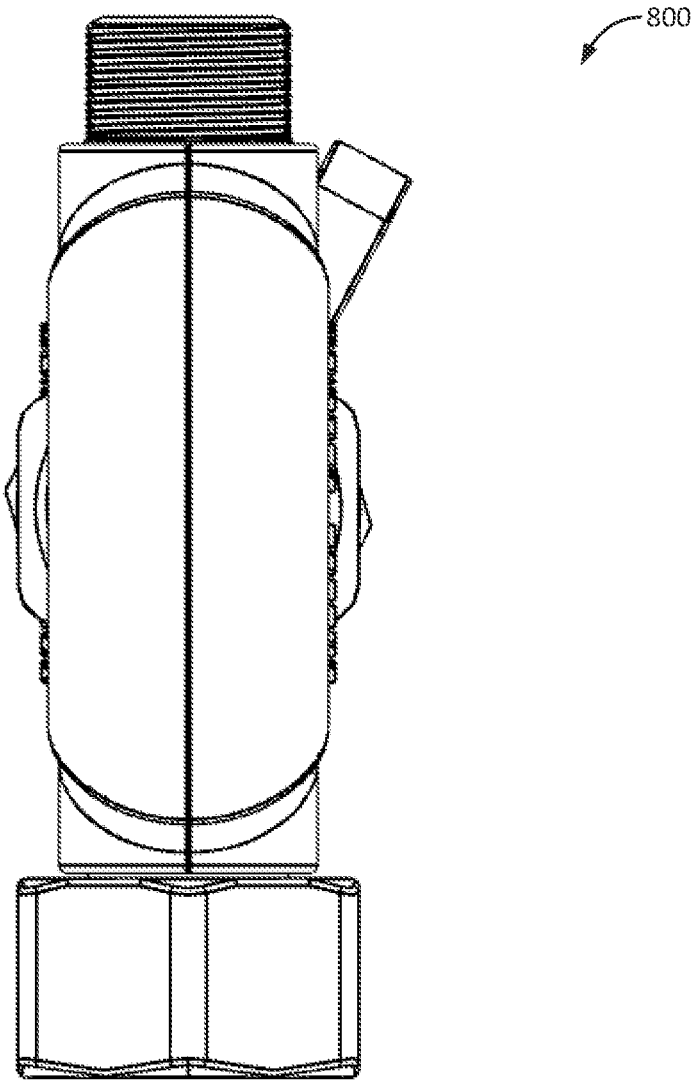
FIG. 8 illustrates a rear view of the temperature-adjusting adapter system in FIG. 3, in accordance with one or more implementations.

FIG. 8 illustrates a rear view of a temperature-adjusting adapter system 800, according to various aspects of the disclosure. In some examples, the temperature-adjusting adapter system 800 implements one or more aspects of the temperature-adjusting adapter system 300, described above in relation to FIG. 3.

Figure 9:
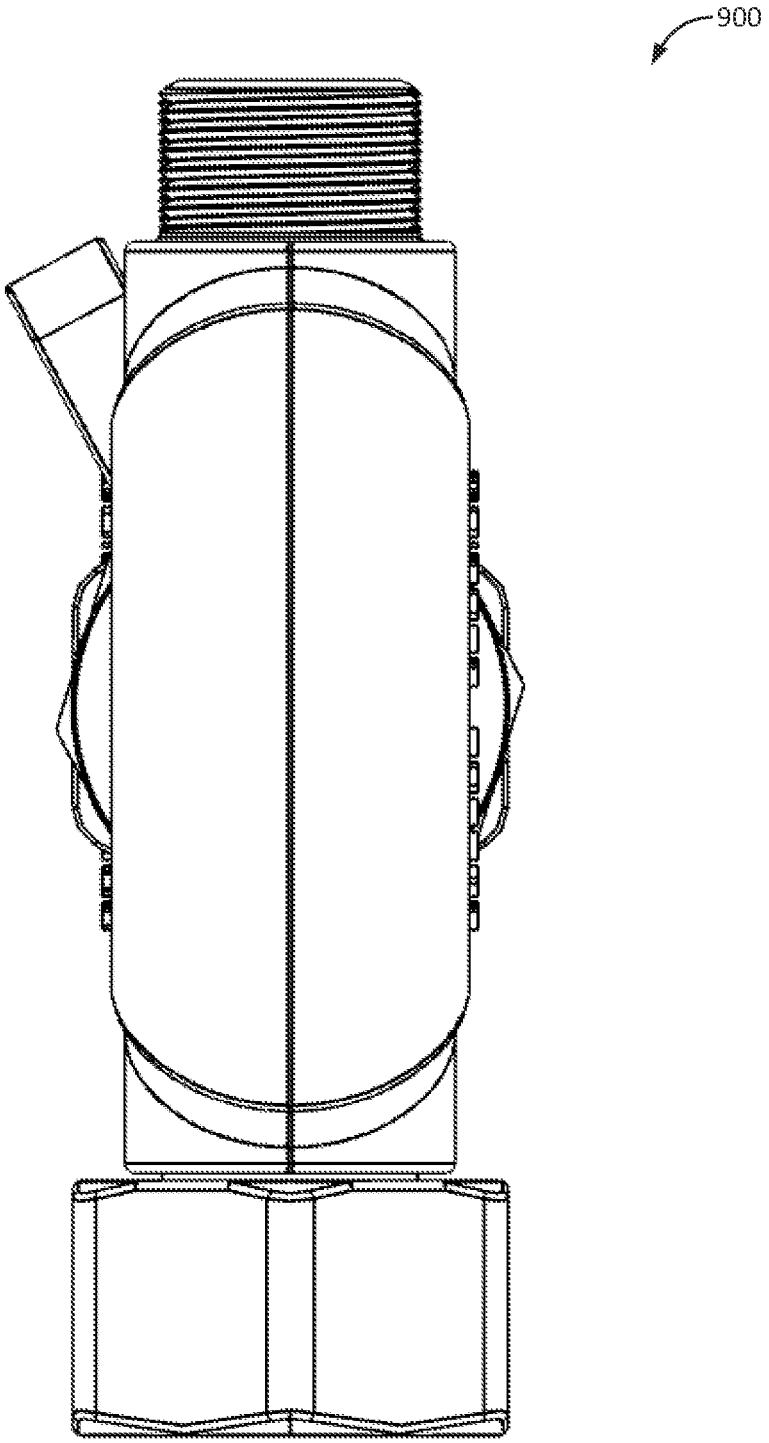
FIG. 9 illustrates a front view of the temperature-adjusting adapter system in FIG. 3, in accordance with one or more implementations.

FIG. 9 illustrates a front view of a temperature-adjusting adapter system 900, according to various aspects of the disclosure. In some examples, the temperature-adjusting adapter system 900 implements one or more aspects of the temperature-adjusting adapter system 300, described above in relation to FIG. 3.

Figure 10:
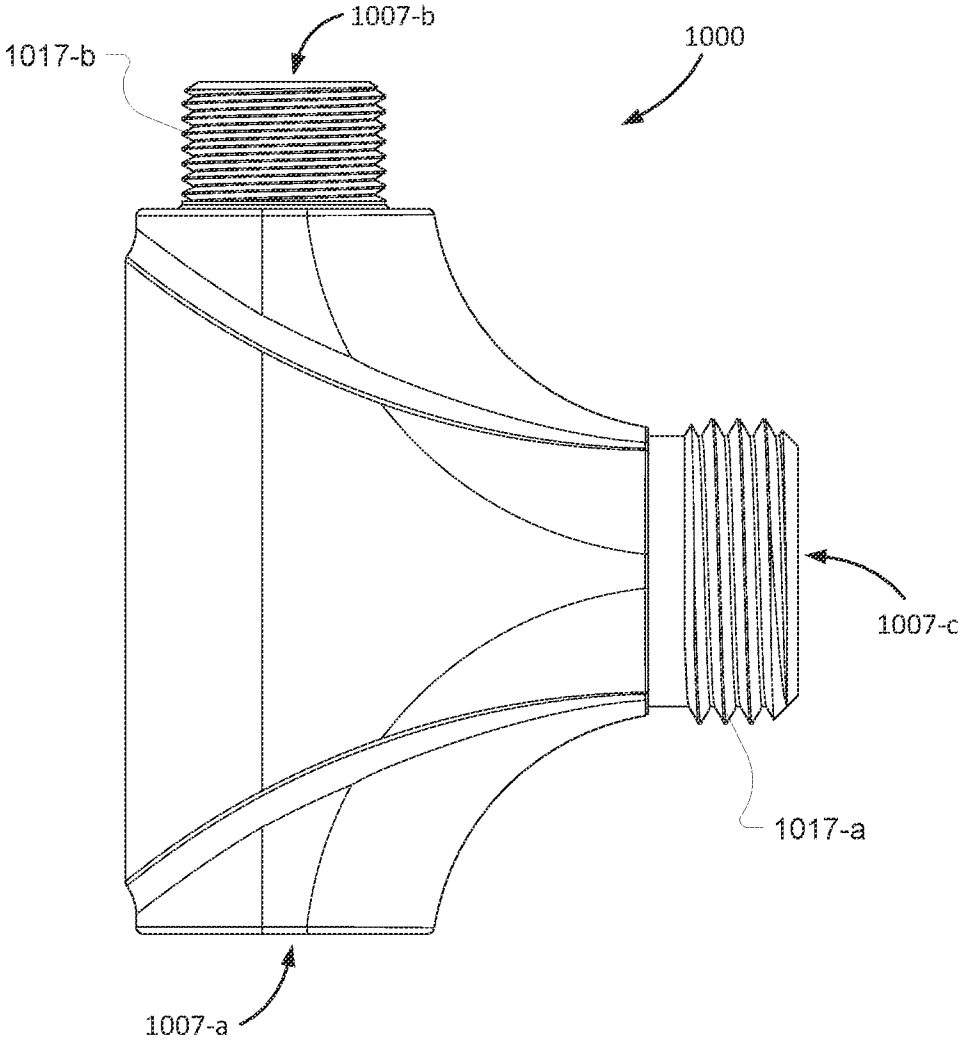
FIG. 10 illustrates an example of a connector for use in a temperature-adjusting adapter system, according to various aspects of the disclosure.

FIG. 10 illustrates a side view of a connector 1000 for use in a temperature-adjusting adapter system, in accordance with one or more implementations. The connector 1000 may be similar or substantially similar to one or more of the connectors 302-*a* and/or 302-*b*, previously described in relation to FIG. 3. As seen, the connector 1000 includes one or more ports 1007 (e.g., port 1007-*a*, port 1007-*b*, port 1007-*c*). In some examples, port 1007-*a* may be configured to be coupled at or near an incoming fluid supply line from a building and may be referred to as the input port 1007-*a* of the connector 1000. Further, port 1007-*b* may be referred to as the output port and may be coupled at or near an input end (e.g., a hose system) of a faucet or tap, for instance. In some cases, the port 1007-*c* may be coupled to an adjustment mechanism (e.g., shown as adjustment mechanism 304 in FIG. 3) of an adapter system, and may serve as the adjustment port of the connector 1000. Port 1007-*c* may be similar or substantially similar to one or more of the adjustment ports (e.g., ports 307-*f* and/or 307-*g*), previously described in relation to FIG. 3. In some cases, the adjustment mechanism, and a tube/hose may be positioned between the port 1007-*c* and another adjustment port of a second connector. While not necessary, in some examples, the second connector may be identical or almost identical to the connector 1000.

In the example shown, the connector 1000 includes one or more threaded ends 1017 (e.g., threaded end 1017-*a*, threaded end 1017-*b*) at one or more of the ports 1007. In some cases, the one or more threaded ends 1017 may be male-type threaded ends for mating or interfacing with a corresponding female-threaded part. The connector 1000 may also include a female-type threaded end, for instance, at the port 1007-*a*. FIG. 12A, which illustrates a bottom view of the connector in FIG. 10, depicts an example of an input port having a female-type threaded end.

Figure 11:
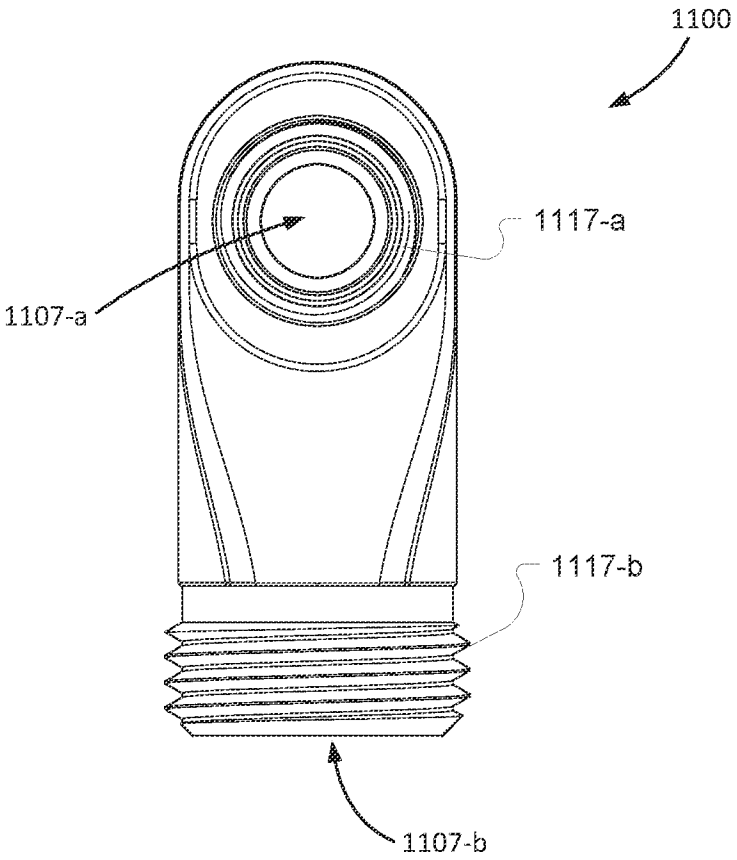
FIG. 11 illustrates a top view of the connector in FIG. 10, according to various aspects of the disclosure.

FIG. 11 illustrates a top view of a connector 1100, in accordance with one or more implementations. The connector 1100 may be similar or substantially similar to one or more of the connector(s) described herein, including at least connector 1000. As seen, the connector 1100 includes one or more ports 1107, such as a first port 1107-*a* (e.g., an output port, maybe similar or substantially similar to output port 307-*b* in FIG. 3) and a second port 1107-*b* (e.g., an adjustment port, maybe similar or substantially similar to port 307-*f* in FIG. 3). In some examples, the connector 1100 may include threaded ends 1117 (e.g., male-type threaded ends) surrounding the one or more ports 1107. For instance, a male-type threaded end (e.g., threaded end 1117-*a*) surrounding the port 1107-*a* may enable the connector 1100 to couple to an existing hose system or input end of a faucet. Additionally, a male-type threaded end (e.g., threaded end 1117-*b*) surrounding the port 1107-*b* may allow the connector 1100 to securely couple to an adjustment mechanism (e.g., shown as adjustment mechanism 304 in FIG. 3) of a temperature-adjusting adapter system. In some embodiments, the adjustment mechanism may comprise an internally threaded nut (e.g., shown as nut 310-*b* in FIG. 3), which may allow it to mate with the male-type threaded end surrounding the port 1107-*b* of the connector 1100.

FIG. 12A illustrates a bottom view of a connector 1200-*a*, according to various aspects of the disclosure. The connector 1200-*a* may be similar or substantially similar to one or more of the connectors 1000 and/or 1100, described above in relation to FIGS. 10 and/or 11. As illustrated, the connector 1200-*a* includes a plurality of ports 1207 (e.g., a port 1207-*a*, which may be an adjustment port coupled to an adjustment mechanism; a port 1207-*b*, which may be an input port coupled to an incoming supply line from the building), where each port 1207 is surrounded by a threaded end. For instance, the connector 1200-*a* includes a threaded end 1217-*b* (e.g., female-type threaded end) surrounding the port 1207-*b*, and a threaded end 1217-*a* (e.g., male-type threaded end) surrounding the port 1217-*a*.

Figure 12B:
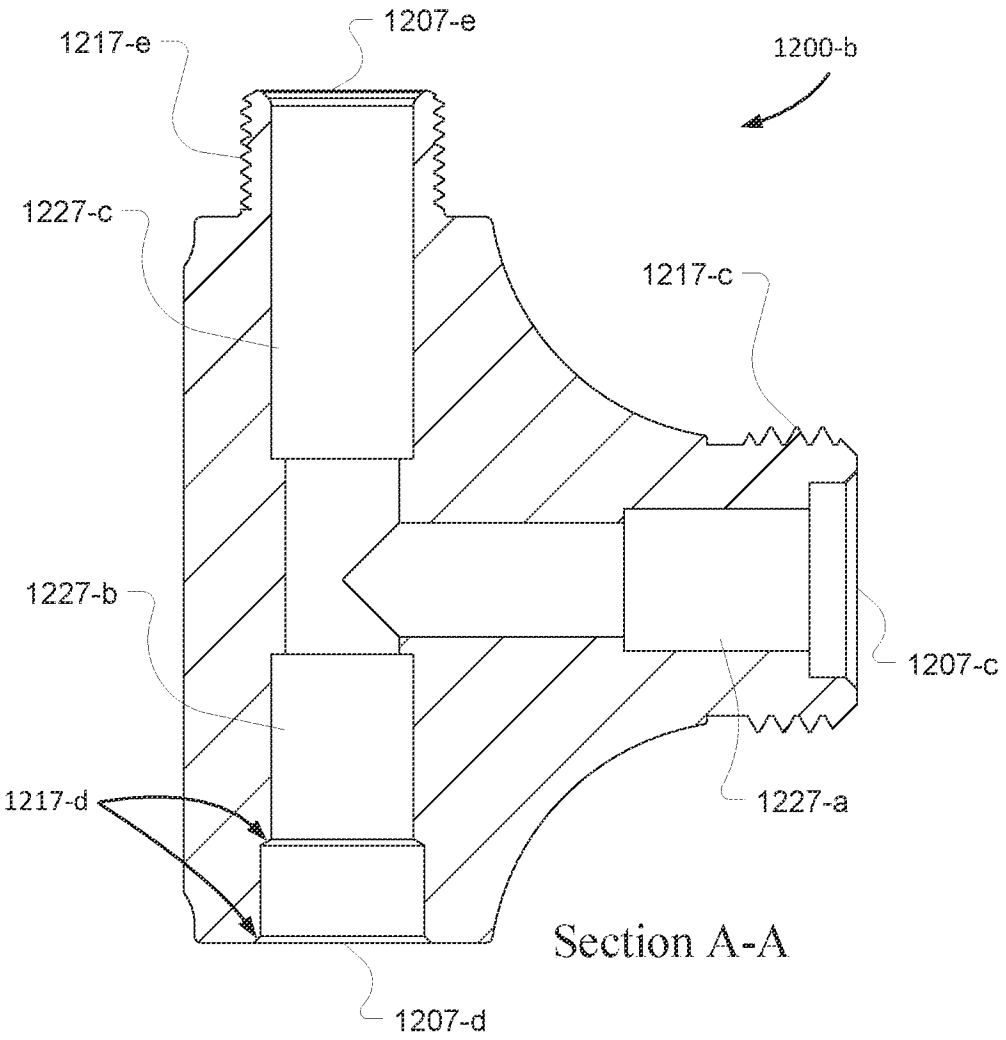
FIG. 12B illustrates a cross-section view of the connector in FIGS. 10, 11 and/or 12A, according to various aspects of the disclosure.
Figure 12A:
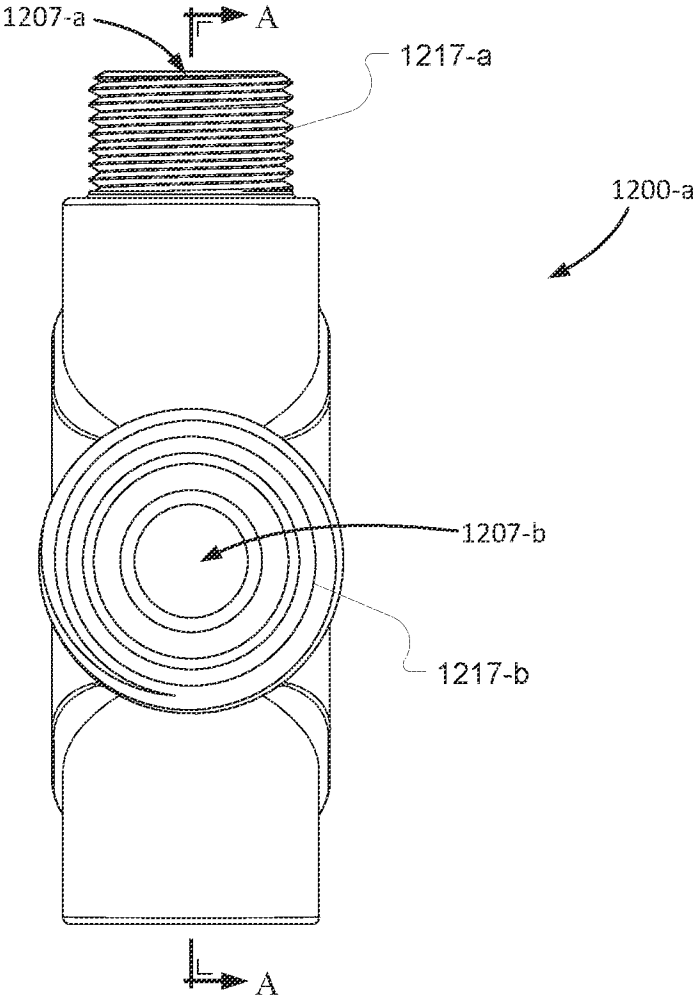
FIG. 12A illustrates a bottom view of the connector in FIGS. 10 and/or 11, according to various aspects of the disclosure.

FIG. 12B illustrates a cross-section view of the connector in FIG. 12A, in accordance with one or more implementations. As seen, FIG. 12B illustrates a connector 1200-*b* comprising a plurality of ports (e.g., ports 1207-*c*, 1207-*d*, and 1207-*e*), each surrounded by a threaded end 1217. Although not necessary, in some examples, the connector 1200-*b* may include a female-type threaded end (e.g., threaded end 1217-*d*) at or near the input port (e.g., port 1207-*d*) and male-type threaded ends (e.g., threaded ends 1217-*c*, 1217-*e*) at or near the output and adjustment ports. In this example, port 1207-*e* may serve as the output port, while port 1207-*c* may serve as the adjustment port. Each of the ports 1207 may be interconnected via one or more channels 1227 (e.g., channels 1227-*a*, 1227-*b*, 1227-*c*). The outer diameter of the male-type threaded ends (i.e., threaded ends 1217-*c*, 1217-*e*) may be shaped and sized to mate with a corresponding female-type threaded part. Further, the female-type threaded end (i.e., threaded end 1217-*d*) may be shaped and sized to receive a male-type threaded part, such as an insert (e.g., shown as insert 1400 in FIG. 14). In some cases, the insert may help couple the connector 1200-*b* to an incoming water supply line.

Figure 13:
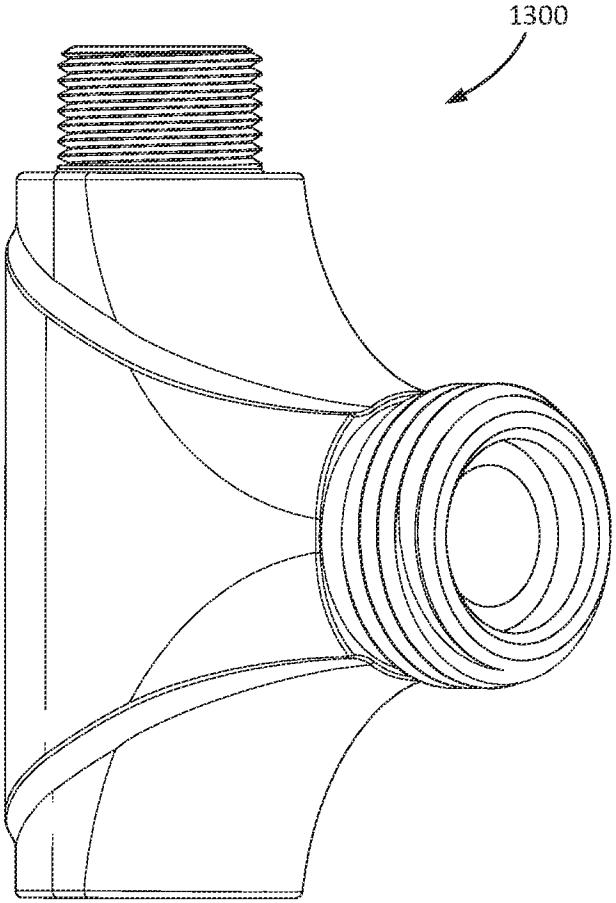
FIG. 13 illustrates a perspective view of a connector for use in a temperature-adjusting adapter system, according to various aspects of the disclosure.

FIG. 13 illustrates a perspective view of a connector 1300, according to various aspects of the disclosure. The connector 1300 may be similar or substantially similar to the connector 1000, previously described in relation to FIG. 10.

Figure 14A:
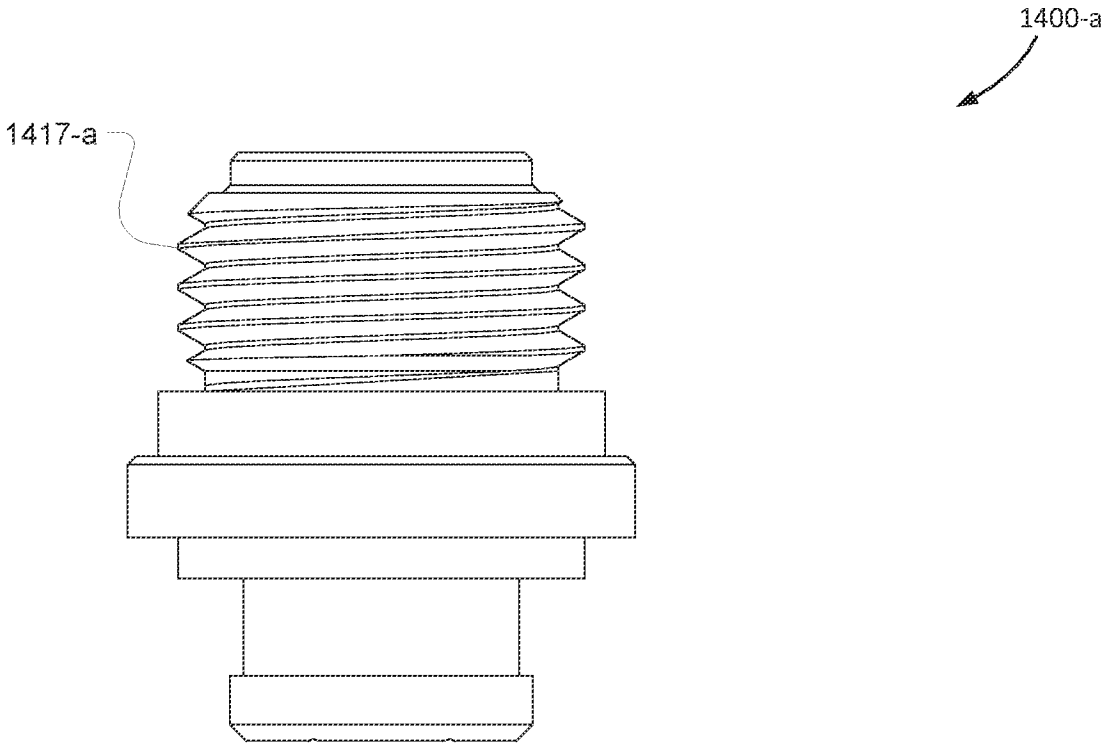
FIG. 14A illustrates a front view of an insert for a temperature-adjusting adapter system, according to various aspects of the disclosure.

FIG. 14A illustrates a front view of an insert 1400-*a*, in accordance with one or more implementations. As seen, the insert 1400 includes a threaded end 1417-*a* (e.g., a male-type threaded end) that may be shaped and sized to mate with a female-type threaded end, for instance, threaded 1217-*d* in FIG. 12B, of a connector.

Figure 14C:
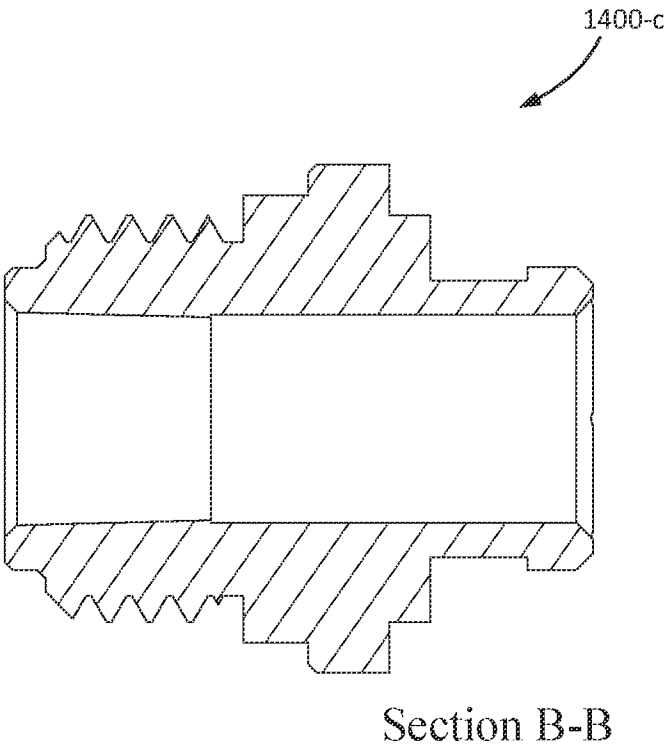
FIG. 14C illustrates a cross-section view of the insert in FIG. 14B, in accordance with one or more implementations.
Figure 14B:
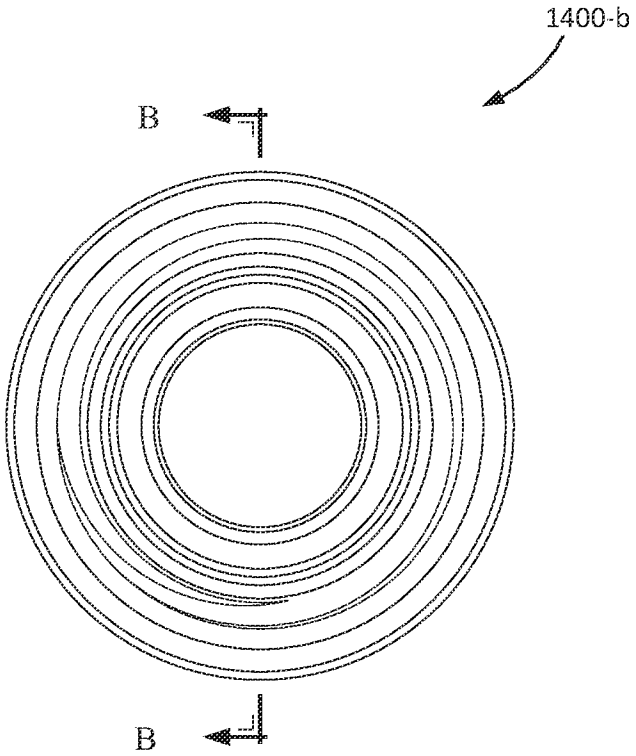
FIG. 14B illustrates a top view of the insert in FIG. 14A, in accordance with one or more implementations.

FIG. 14B illustrates a top view of an insert 1400-*b*, in accordance with one or more implementations. The insert 1400-*b* may be similar or substantially similar to the insert 1400-*a* described in relation to FIG. 14A.

FIG. 14C illustrates a cross-section view of an insert 1400-*c*, in accordance with one or more implementations. In some examples, FIG. 14C depicts a cross-section of the insert 1400-*b* in FIG. 14B.

Figure 14D:
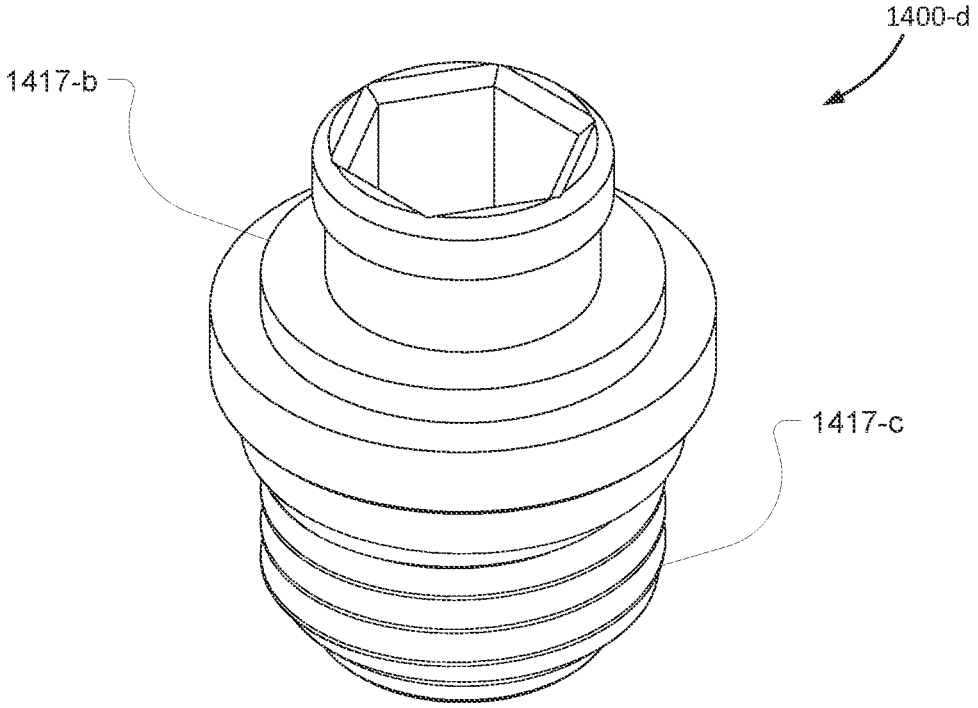
FIG. 14D illustrates a bottom perspective view of the insert in FIG. 14A, in accordance with one or more implementations.

FIG. 14D illustrates a perspective view of an insert 1400-*d*, in accordance with one or more implementations. In some cases, threaded end 1417-*c* (i.e., similar to threaded end 1417-*a* in FIG. 14A) may allow the insert 1400-*d* to be coupled to a female-threaded end of a connector, while threaded end 1417-*b* may allow securement to a nut (e.g., shown as nut 1610 in FIG. 16). The nut 1610 may be further secured to the incoming supply line (e.g., a hose having a male-type threaded end), which may serve to couple the input port of the connector to the incoming supply line.

Figure 14E:
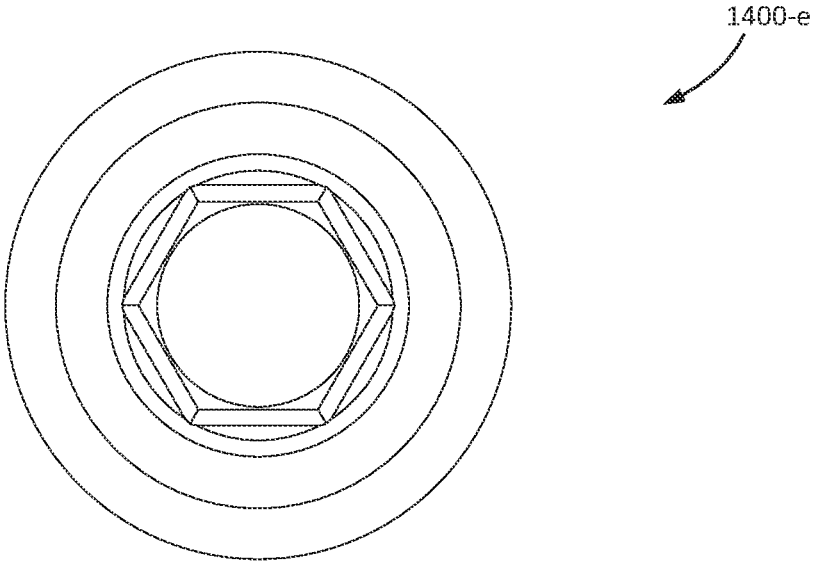
FIG. 14E illustrates a bottom view of the insert in FIG. 14A, in accordance with one or more implementations.

FIG. 14E illustrates a perspective view of an insert 1400-*e*, in accordance with one or more implementations. The inserts 1400-*d* and/or 1400-*e* seen in FIGS. 14D and/or 14E may be similar or substantially similar to the insert 1400-*a*.

Figure 15:
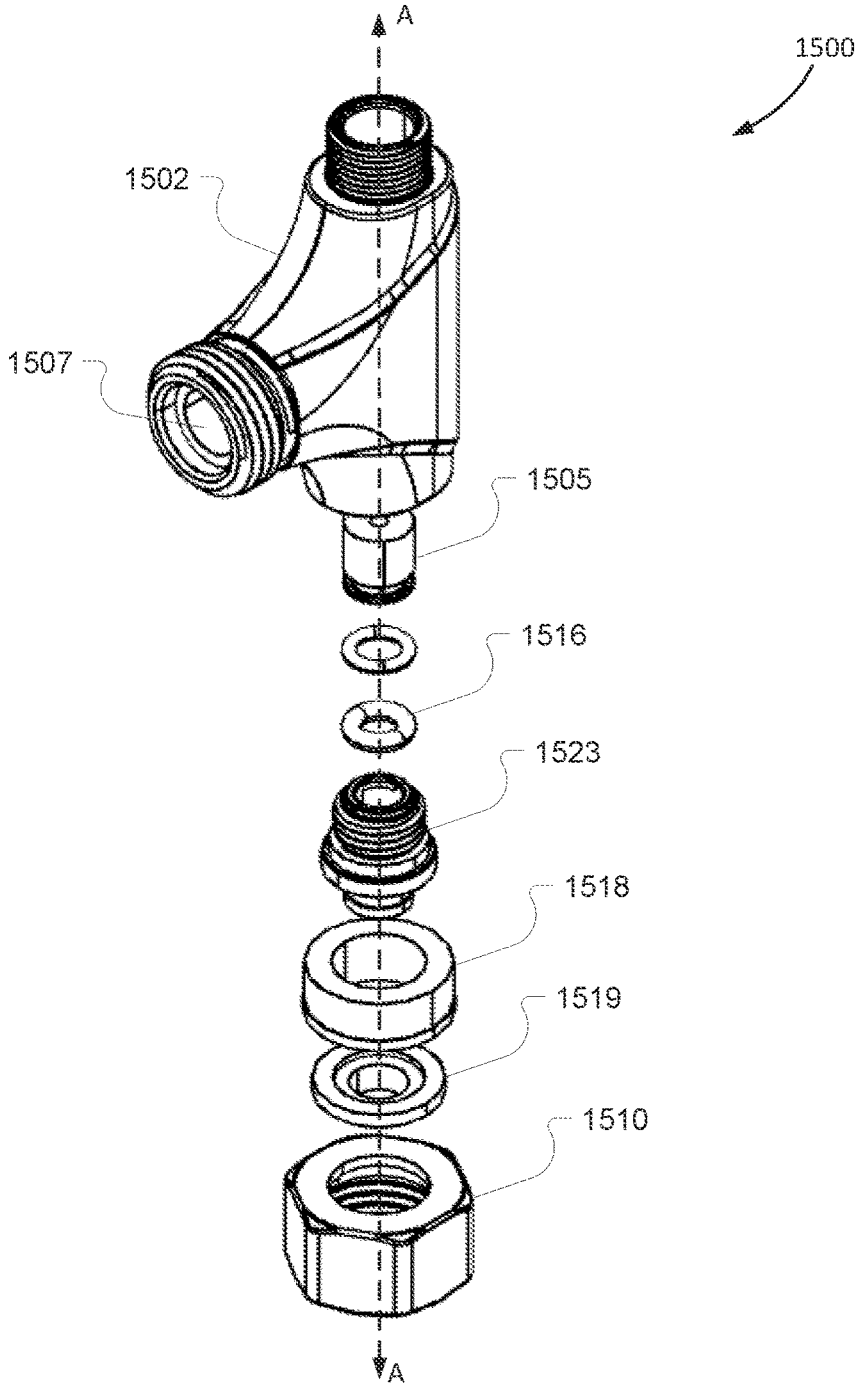
FIG. 15 illustrates an exploded view of a first section of the temperature-adjusting adapter system in FIG. 3, according to various aspects of the disclosure.

FIG. 15 illustrates an exploded view 1500 of a first section (e.g., to the right of the page in FIG. 3) of the temperature-adjusting adapter system in FIG. 3, according to various aspects of the disclosure. In this example, the exploded view 1500 shows a connector 1502, a one-way check valve 1505 (e.g., similar or substantially similar to the one-way check valve 105 described in relation to FIG. 1), an insert 1523 (e.g., similar or substantially similar to the insert(s) 1400 described in relation to FIGS. 14A-14E), a threaded insert 1518 (optional), one or more washers 1516, a nut 1510, and a ferrule 1519. It should be noted that, the illustration in FIG. 15 is not intended to be limiting and one or more of the elements seen in FIG. 15 may be optional. In some embodiments, the one-way check valve 1505 (also referred to as first valve 1505) may be one of coupled and integrated to the connector 1502, for instance, at or near the input port (e.g., shown as input port 307-*a* in FIG. 3) of the connector. In some cases, the connector 1502 may be an example of a hot side tee connector (e.g., shown as hot side tee connector 103 in FIG. 1). As noted above, in some examples, both the one-way check valves may be one of coupled to or integrated with the hot side tee connector. For example, another one-way check valve (e.g., shown as one-way check valve 1705 in FIG. 17B) may be coupled or integrated to the connector 1502, for instance, at or near a port 1507 (also shown as adjustment port 307-*f* in FIG. 3).

Figure 16:
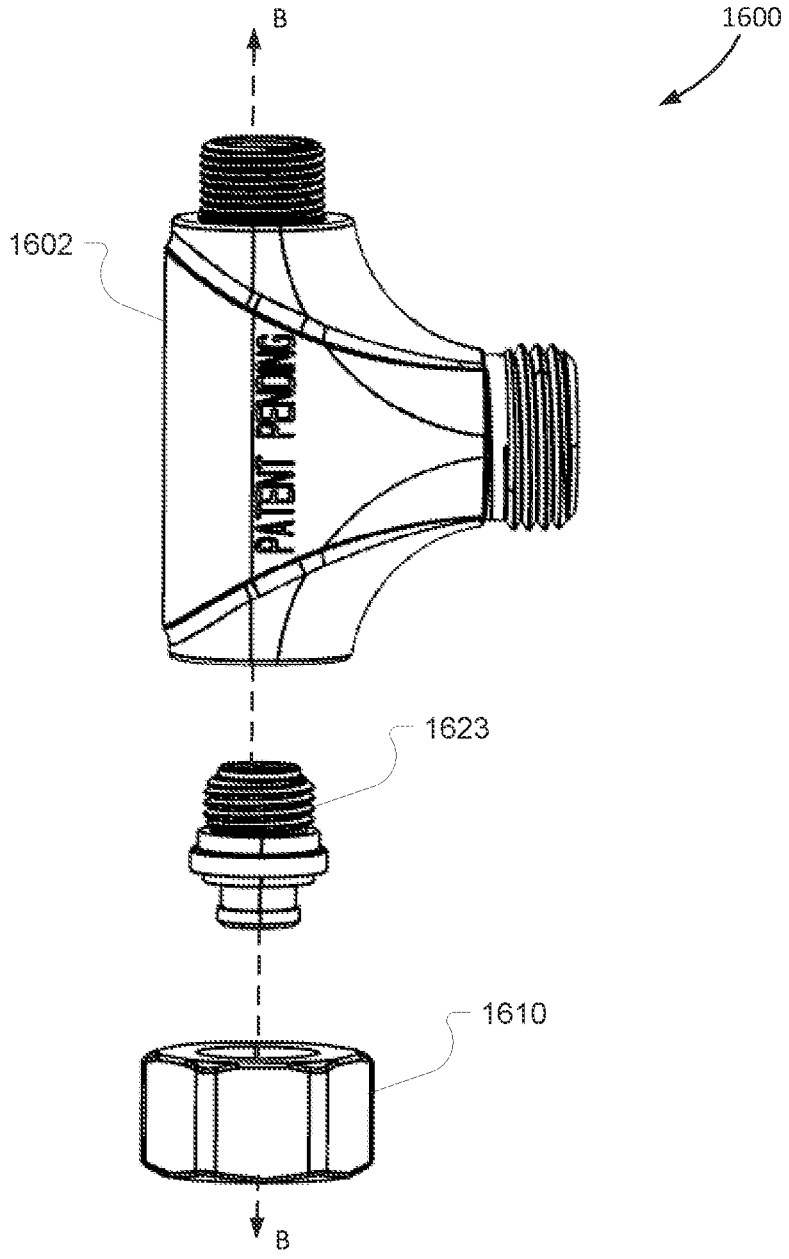
FIG. 16 illustrates an exploded view of a second section of the temperature-adjusting adapter system in FIG. 3, according to various aspects of the disclosure.

FIG. 16 depicts an exploded view 1600 of a second section (e.g., to the left of the page in FIG. 3) of the temperature-adjusting adapter system in FIG. 3, according to various aspects of the disclosure. In this example, the exploded view 1600 shows a connector 1602, an insert 1623, and a nut 1610 for coupling the connector and insert assembly to an incoming water supply line.

Figure 17A:
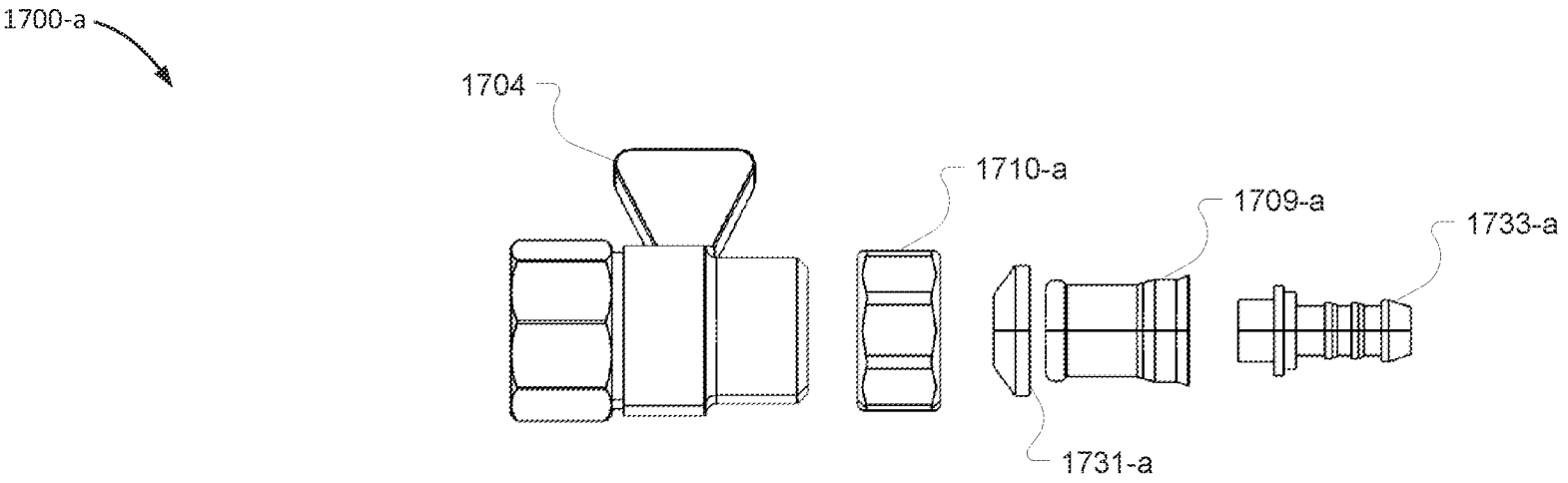
FIG. 17A illustrates an exploded view of a third section of the temperature-adjusting adapter system in FIG. 3, according to various aspects of the disclosure.

FIG. 17A illustrates an exploded view 1700-*a* of a third section of the temperature adjusting adapter system in FIG. 3, for instance, between the adjustment port (e.g., port 307-*g*) and the hose 306. In this example, the exploded view 1700-*a* shows an adjustment mechanism 1704, a nut 1710-*a*, a ferrule 1731-*a*, a crimp 1709-*a*, and a barbed hose fitting 1733-*a*.

Figure 17B:
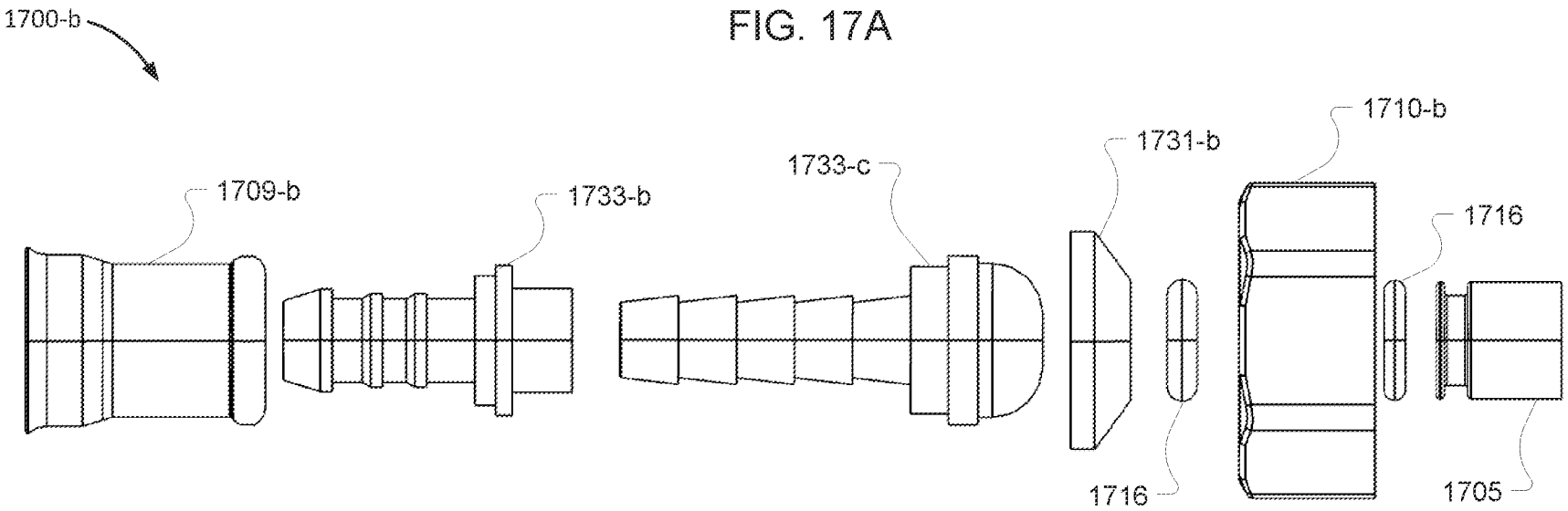
FIG. 17B illustrates an exploded view of a fourth section of the temperature-adjusting adapter system in FIG. 3, according to various aspects of the disclosure.

FIG. 17B illustrates an exploded view 1700-*b* of a fourth section of the temperature adjusting adapter system in FIG. 3, for instance, between the adjustment port (e.g., port 307-*f*) and the tube or hose 306. In this example, the exploded view 1700-*b* shows a one-way check valve 1705, one or more washers 1716, a nut 1710-*b*, a ferrule 1731-*b*, one or more barbed hose fittings (e.g., barbed hose fitting 1733-*b*, barbed hose fitting 1733-*c*), and a crimp 1709-*b*. As seen, the crimp 1709-*b* is shaped and sized to receive (or alternatively, coupled to) an outer surface of the tube (e.g., shown as tube or hose 306 in FIG. 3). It should be noted that, one or more of the elements shown in FIGS. 17A and/or 17B may be optional. Further, different securement/attachment mechanisms for providing a tight and secure fit between the connectors, the adjustment mechanism, the tube or hose (e.g., tube 306 in FIG. 3), and the one-way check valve 1705 may be contemplated in different embodiments.

Figure 18:
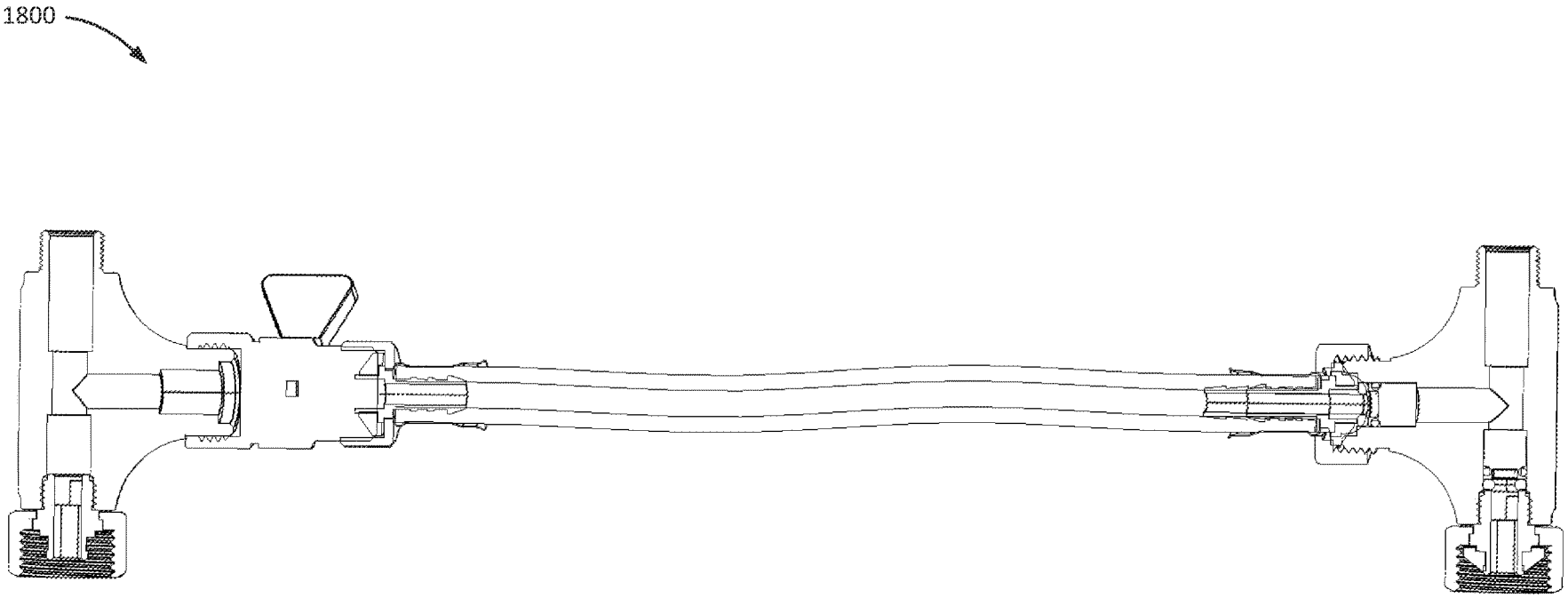
FIG. 18 illustrates a cross-section view of the temperature-adjusting adapter system in FIG. 4, according to various aspects of the disclosure.

FIG. 18 illustrates a cross-section view of a temperature-adjusting adapter system 1800, according to various aspects of the disclosure.

Thus, in some aspects, the present disclosure relates to a temperature-adjusting adapter system comprising multiple tee connectors with or without built-in faucet hoses, which may allow a user with minimal plumbing experience and/or tools to easily adjust hot and cold water mixing at single faucet sinks. Such a temperature-adjusting adapter system may serve to enhance user experience and minimize the risk of scalding, while ensuring hot water of a required temperature is still output at other fixtures/devices in the building.

1. As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A temperature-adjusting adapter system, comprising:

a first connector, wherein the first connector comprises at least two ports, including a first connector input port for receiving a first fluid at a first temperature and a first connector output port;

a second connector, wherein the second connector comprises at least three ports, including a second connector input port for receiving a second fluid at a second temperature, a second connector output port, and a second connector adjustment port;

a tube having a first end and a second end, wherein the first end is one of coupled and integrated at or near one of the at least two ports of the first connector and the second end is one of coupled and integrated at or near the second connector adjustment port;

an adjustment mechanism one of coupled and integrated to the tube, wherein a change in an adjustment mechanism position varies an amount of second fluid transferred from the second connector to the first connector wherein, the combination of the second fluid transferred from the second connector and the first fluid at the first connector comprises a third fluid, and the third fluid comprises a temperature lower than the first temperature;

a first valve positioned between the first connector and the second connector; and a second valve positioned at or near the first connector.

2. The system of claim 1, further comprising:

one or more crimps, wherein:

each of the one or more crimps comprise an inner diameter and are positioned between the first connector and the second connector adjustment port;

the first valve comprises a check valve; and the check valve fits within the inner diameter.

3. The system of claim 2, wherein:

the tube comprises an outer surface having an outer diameter;

the one or more crimps couple to the outer surface;

the adjustment mechanism is one of coupled and integrated at or near one of the first end and the second end of the tube; and the temperature of the third fluid comprises a third temperature.

4. The system of claim 1, wherein the first and the second valves comprise one-way check valves.

5. The system of claim 4, wherein one of the first and the second valves prevents back flow of the first fluid from the first connector to the second connector input port and the second connector output port.

6. The system of claim 5, wherein another of the first and the second valves prevents back flow of the second fluid and the third fluid to the first connector input port.

7. The system of claim 4, wherein a cracking pressure of the first valve comprises a pressure less than 0.5 psi, less than 1 psi, or less than 2 psi, and wherein a cracking pressure of the second valve comprises a pressure less than 0.5 psi, less than 1 psi, or less than 2 psi.

8. The system of claim 1, wherein the first connector and the second connector are selected from a group consisting of a T-junction or tee connector, a compression connector, a solder connect connector, a National Pipe Tapered Threads (NPT) connector, and a National Pipe Straight Thread (NPS) connector.

9. The system of claim 1, wherein:

the second temperature is lower than the first temperature; and the first fluid is the same as the second fluid.

10. The system of claim 1, wherein:

the first connector further comprises a first connector adjustment port; and the first end of the tube is connected at or near the first connector adjustment port.

11. The system of claim 10, wherein the adjustment mechanism comprises an adjustment valve, the adjustment valve selected from a group consisting of a ball valve, a disc valve, a disc-type valve, a fluid metering valve, and an adjustable flow valve.

12. The system of claim 11, wherein at least a portion of the second fluid flows through the adjustment valve, the tube, and at least one check valve.

13. The system of claim 11, wherein at least a portion of the second fluid flows through the second connector output port.

14. The system of claim 11, wherein:

the adjustment mechanism further comprises one of a rotating handle, a rotating switch, a knob, a lever, and a dial; and the one of a rotating handle, a rotating switch, a knob, a lever, and a dial is coupled to the adjustment valve and utilized to adjust the flow of the first fluid through the adjustment valve.

15. The system of claim 14, wherein:

the adjustment mechanism is movable between an open position and a closed position;

a mixing ratio of the second fluid to the first fluid exiting the first connector output port in the open position comprises a maximum mixing ratio; and the mixing ratio of the second fluid to the first fluid exiting the first connector in the closed position comprises a minimum mixing ratio.

16. The system of claim 15, wherein:

when the adjustment mechanism is moved to the open position, the mixing ratio of the second fluid to the first fluid exiting the first connector output port is at least about 50% or about 1:1; and when the adjustment mechanism is moved to the closed position, the mixing ratio of the second fluid to the first fluid exiting the first connector output port is about 0% or 0:1.

17. The system of claim 16, wherein, when the adjustment mechanism is moved to the closed position, all, or a majority of the second fluid entering the second connector input port flows through the second connector output port.

18. The temperature-adjusting adapter system of claim 1 wherein the second valve positioned at or near the first connector comprises a valve positioned in the first connector.

19. A faucet system, comprising:

a faucet having at least two input ends and an output end, wherein the output end is in communication with the at least two input ends;

a first supply line for providing a first fluid at a first temperature;

a second supply line for providing a second fluid at a second temperature; and a temperature-adjusting adapter system coupled to the first supply line, the second supply line, and the at least two input ends of the faucet, the temperature-adjusting adapter system comprising:

a first connector, wherein the first connector comprises at least two ports, including a first connector input port and a first connector output port, wherein the first connector output port is connected to one of the at least two input ends of the faucet, a second connector, wherein the second connector comprises at least three ports, including a second connector input port, a second connector output port, and a second connector adjustment port, wherein the second connector output port is connected to another of the at least two input ends of the faucet, a tube having a first end and a second end, wherein the first end is one of coupled and integrated at or near one of the at least two ports of the first connector and the second end is one of coupled and integrated at or near the second connector adjustment port, an adjustment mechanism one of coupled and integrated to the tube, wherein a change in an adjustment mechanism position varies an amount of second fluid transferred from the second connector to the first connector wherein, the combination of the second fluid transferred from the second connector and the first fluid at the first connector comprises a third fluid, and the third fluid comprises a temperature lower than the first temperature, a first valve positioned between the first connector and the second connector, and a second valve positioned at or near the first connector.

* * * * *